US007744128B2

(12) United States Patent
El-Sorrogy

(10) Patent No.: US 7,744,128 B2
(45) Date of Patent: Jun. 29, 2010

(54) DEVICES AND METHODS FOR SUPPORTING PRINTED MATTER

(75) Inventor: Rania Nabil El-Sorrogy, Barrington, IL (US)

(73) Assignee: Striding Trees, LLC, Barrington, IL (US)

( * ) Notice: Subject to any disclaimer, the term of this patent is extended or adjusted under 35 U.S.C. 154(b) by 0 days.

(21) Appl. No.: 11/797,100

(22) Filed: Apr. 30, 2007

(65) Prior Publication Data

US 2007/0252377 A1 Nov. 1, 2007

Related U.S. Application Data

(60) Provisional application No. 60/796,167, filed on Apr. 28, 2006.

(51) Int. Cl.
*B42D 1/06* (2006.01)

(52) U.S. Cl. ..... 281/21.1; 281/4; 281/16; 281/17; 281/19.1; 281/29

(58) Field of Classification Search ..... 283/2, 283/4, 34, 63, 64.1, 62, 61; 281/4, 21.1, 281/19.1, 16–18, 3.1, 29, 15.1; 24/67 R, 24/67.9, 67.11; 402/64, 18, 19, 21
See application file for complete search history.

(56) References Cited

U.S. PATENT DOCUMENTS

| | | | | | |
|---|---|---|---|---|---|
| 2,127,619 | A | * | 8/1938 | Rosenthal | 281/17 |
| 3,353,844 | A | * | 11/1967 | Staats | 281/17 |
| 3,752,503 | A | * | 8/1973 | Holes et al. | 281/17 |
| 5,104,147 | A | * | 4/1992 | King | 281/21.1 |
| 5,433,480 | A | * | 7/1995 | Gresham et al. | 281/17 |

* cited by examiner

*Primary Examiner*—Dana Ross
*Assistant Examiner*—Pradeep C Battula
(74) *Attorney, Agent, or Firm*—Moazzam & Associates, LLC

(57) ABSTRACT

A book block is contemplated to be bound in its individual sections through various techniques. These sections will be attached to the book cover by a magnetic or mechanical way. The user of the book will then be allowed to select and detach individual sections of the book without destroying the integrity of the entire book block. Likewise, publishers of the book are now able to update and/or replace sections of an entire book block without needing to reprint and republish the whole book.

8 Claims, 21 Drawing Sheets

DEVICES AND METHODS FOR SUPPORTING PRINTED MATTER

This application claims priority to U.S. Provisional Patent Application Ser. No. 60/796,167, filed Apr. 28, 2006, the content of which is hereby incorporated by reference in its entirety into this disclosure.

BACKGROUND OF THE INVENTION

1. Field of the Invention

The present invention relates to supporting of printed matter. In particular, the present invention relates to the support of various reading and/or viewing printed material including books, brochures, catalogs and the like.

2. Background of the Invention

As the volume of literature increases, additional costs are associated with the manufacture of printed material, including books, brochures, catalogs, magazines, and the like. Some of this printed matter becomes very large or heavy, particularly because of their tremendous volume or size. Despite the advancement of literature and information, conventional methods of manufacture in the art of bookbinding has been relatively constant and has essentially been limited to (i) case binding and (ii) perfect binding. Traditional Smyth sewn books require a series of arranging, sewing, and gluing steps to adhere signatures (sections of the entire book) to the cover spine. Typically, textbooks and other large-mass books employ the Smyth sewn binding technique.

Perfect bound books mainly require an adhesive binding between the book block and the cover. After the technological booms following World War II, perfect binding became an economical option for many publishers, making it a common practice in contemporary times. Nearly all paperback books, telephone books, and other small-mass books are bound using the perfect binding technique.

Large-mass books are typically perfect bound or bound using the Smyth sewn technique. Many of these large-mass books are published in the form of textbooks or trade books for school students. Such large and heavy books take their toll on those who have to carry these books on a daily or regular basis, typically students. The American Chiropractic Association (ACA) and the American Occupational Therapy Association (AOTA) states that children should not carry more than 10% of their bodyweight. Researchers have found, however, that children are carrying 22% of their bodyweight in studies conducted in the United States.

The National Safety Council states that according to the US Consumer Product Safety Commission there were more than 21,000 backpack related injuries that ended up being treated in emergency rooms, clinics and doctors' offices in 2003. The range of these injuries was widespread from contusions, to sprains, and even fractures.

Some subject matters require new versions of texts in order to account for changes that took place after the initial publication of the book. Using bookbinding methods of the art, the entire text is replaced when revisions are made to a sufficient number of sections. Some fields, such as legal texts, use "pocket parts," which are smaller independent sections showing only the changes; but the main body of text is unchanged, and both the main body of text and the pocket part must be referenced in order to read the actual updated text. Using existing techniques of the art, there is no other way to replace merely a section of the book.

Thus, there is a need in the art for a more effective technique for manufacturing printed matter such that portions of the printed matter may be carried independently of the other portions, and allowed to be changed, revised or replaced without having to do so for the entire volume in which such portion is a part. The technique should be simple to understand, use and manufacture so that it provides an efficient and less costly alternative to constant volume changes and/or provides an efficient method of carrying just one portion of a large size or volume printed matter.

SUMMARY OF THE INVENTION

The present invention provides a unique technique of manufacturing printed matter such that such matter may be easily taken apart into defined portions and each portion carried or reviewed independently of the other. Each such portion can also be independently updated or revised without affecting the other portions of the matter that have not been changed. The present invention overcomes many problems associated with conventional bookbinding and manufacturing techniques by using a novel and simple technique of combining interlocking components that comprise sections of a reading material, such as a book. Book users need not transport the entirety of a book when they only desire to focus on one chapter or section of the book. With the present invention, the book user can select the portion(s) of the book they would like to carry with her. Likewise, book publishers need not reprint the entirety of a book when they only desire to alter select chapters or sections of the book. With the present invention, the book publisher can select portion(s) of the book that they would like to update, reprint, and sell. Such technique is more advantageous to the publisher because only certain portions of a textbook are revised, the cost of printing is only limited to those particular portions, such as a chapter. That individual portion can then be sold at a substantially reduced rate than having to re-publish and sell the entire textbook. Such high costs of having to re-publish an entire book also prevent many buyers from buying new versions because of the lack of substantial difference from older versions of the same textbook. Thus, with the present technique, the publishers can realize higher sales of only relevant portions of a textbook because consumers are more apt to purchase only portions of a textbook that are updated rather than an entire new textbook.

Using techniques presented herein and according to the present invention, portions or sections of a book will be individually bound, such as but not limited to a perfect binding method. These smaller sections of the whole textbook could be gathered under a book cover. The force used for attraction between the sections and the book cover would be strong enough to keep the entire book block together, when this is the desired use. The sections can also be detached from the book cover and carried separately. A few examples of forces used for attaching the detachable sections include magnetic and mechanical techniques.

For sake of simplicity, exemplary techniques that may be used in conjunction with the present invention have been presented in various groups of embodiments. Also, for sake of simplicity, the various embodiments are presented with use of a "book" for sake of simplicity. However, the present invention and techniques are equally applicable to other forms of printed and bound matter, including but not limited to, magazines, directories, newspapers, brochures, photographic albums, and the like. One of ordinary skill in the art would be cognizant of these and other type of printed or photographic matter that could be used by the techniques presented in the present disclosure. All such uses are within the scope of the present invention.

In a magnetic group of embodiments, devices according to the present invention can include complementary, magnetically-adhering members used in the section covers and book cover. These materials attract each other, permitting the sections to be retained in the book. In some of these embodiments, other products can compliment the embodiment, such as larger head and foot bands. These bands serve as an additional ways by which to secure the book sections are retained within the book cover.

The sections (such as chapters) of a sectional book constructed under the magnetic technique can be magnetically-adhered to the book cover, so that each section may also be separated from the entire book block. Thus, the sections of the book can be individually bound, including a section cover with a magnetically-adhering member. Each section can attach to the book cover (usually along the spine), which can also contain a magnetically adhering member.

In a mechanical group of embodiments, the devices according to the present invention provide mechanical methods for fastening the sections to the book cover. Examples of mechanically-attaching mechanisms include but are not limited to paper fasteners, clips, binders, rods, rivets, and hook and loop fasteners, including Velcro and others. Many other mechanical binding devices may be used and such other devices are apparent to one having ordinary skill in the art and thereby within the scope of the present invention.

The sections (or chapters) of a sectional book constructed using the mechanical method can be mechanically-adhered to the book cover, so that each section may be separated from the entire book block. Thus, sections of the book can be individually bound, and the book cover can include at least one mechanically-attaching member.

The present invention has many uses and advantages as would be apparent to one having ordinary skill in the art after consideration of the present disclosure. Exemplary non-limiting uses and advantages over conventional techniques include, but are not limited to: providing a convenient way for users to select which portions of a book to carry with them; providing a reduction in overall weight carried by the user in the forms of books; providing a way for reducing back-related injuries due to carrying heavy books; providing book publishers a way to update portions of the book without need to reprint the entire book; providing book publishers a way to reduce their overall cost of production for new and/or updated versions of books.

DETAILED DESCRIPTION OF THE INVENTION

Figure 1:
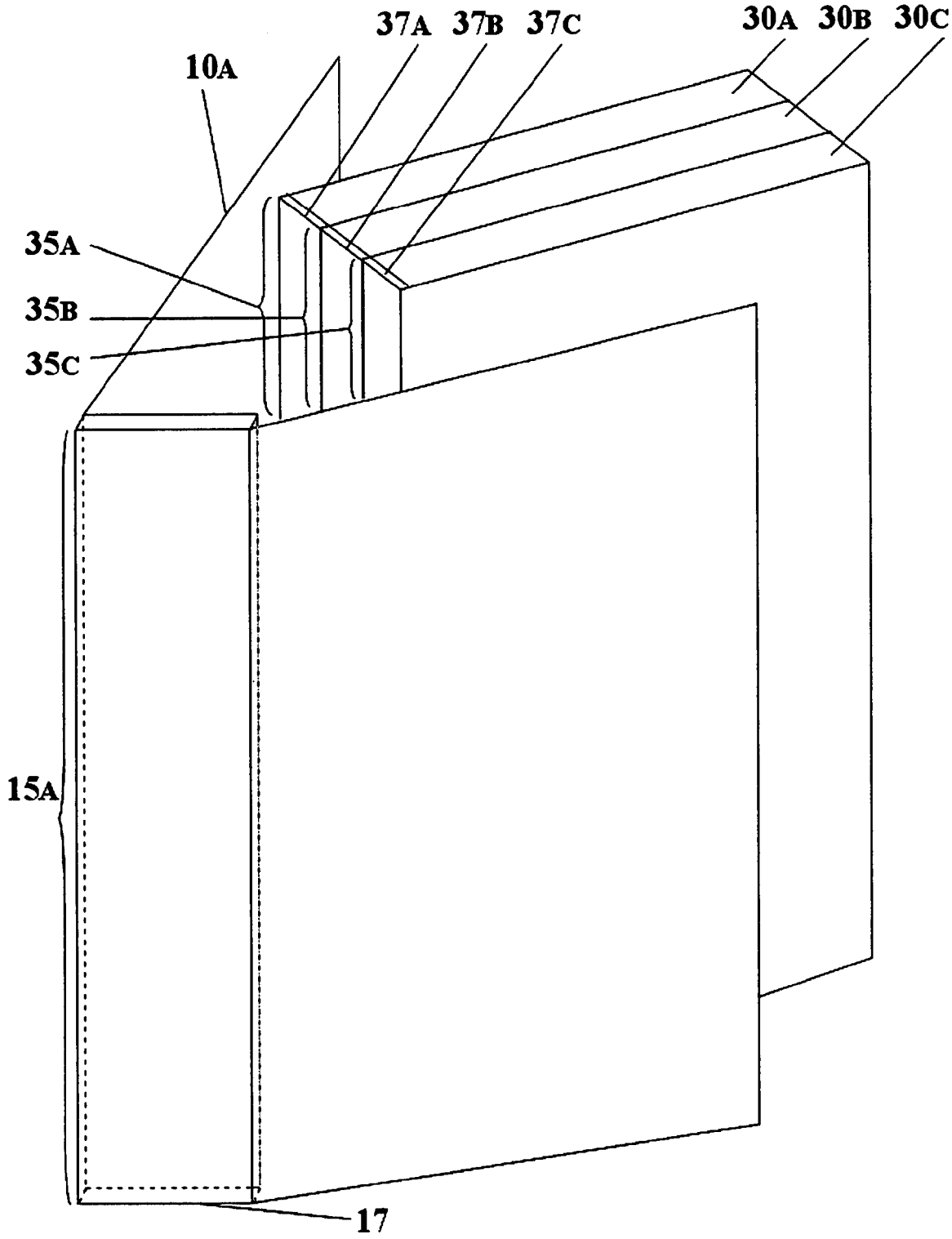
FIG. 1 is a side elevated, exploded view of an exemplary embodiment of the present invention illustrating components that make up a preferred embodiment.

As disclosed in the present description and accompanying drawings, the present invention provides for manufacture, sale, and use of a printed matter incorporating reversibly detachable sections.

To assist in the consideration of the present disclosure and accompanying drawings, the following labels have been used and are generally presented here and described in more detail below:

1A, B, C: Rectangular magnetically-attractive members

2A, B, C: Cubical magnetically-attractive members

3A, B, C: Cylindrical magnetically-attractive members

4A, B, C: Rectangular magnetically-attractive members (metal)

5: Flexible, durable rod
6A, B: Metal rod
7: Alternative rectangular magnetically-attractive strip (magnet)
10A: Book cover
10B: Alternative book cover
11A, B: Openings in cover layers
11C, D: Openings in cover boards
12A, B, E, F: Alternative openings in cover layers
12C, D: Alternative openings in cover boards
13A: Inner book cover layer
13B: Alternative inner book cover layer
14A: Outer book cover layer
14B: Alternative outer book cover layer
15A: Spine region of book cover
15B: Alternative spine region of book cover with variable width
16A, B, C: Book cover boards
16D: Alternative inner support structure for book cover
17: Magnetically-adhering cover member
18A, B: Book cover's complimentary interlocking convex elements
18C, D: Book cover's complimentary concave elements
18E, F: Alternative book cover's complimentary convex elements
19A: Book section's interlocking convex element
19B, C: Book section's complimentary convex elements
19D, E: Alternative book cover's complimentary concave element
20A, B: Rivets
21A, B: Openings in spine region of book section
22: Hook and loop material
23: Complimentary hook and loop material
24A, B: Heads of rivets
25A, B: Clips
26A, B: Levers on clips
27: Lever
28A, B: Durable Rods
29: Void in spine of book cover
30A: Book section
30B: Alternative book section
35A, B, C: Spine region of book section
35D: Alternative spine region of book section
37A, B, C: Magnetically-adhering section member
41A, B: Rubber ends
43A, B: Interlocking members
45A, B, C, D, E, F, G, H, I, J: Openings within these common axes Several general classes of embodiments are presented herein and grouped together only for sake of simplicity. In the magnetic group of embodiments, at least one of the magnetically-adhering members of either the book cover or the section will include a magnet of sufficient strength to attach and retain the sections to the book cover. Combinations of attaching the book section and book cover include (i) magnet-metal, (ii) metal-magnet, and (iii) magnet-magnet.

FIG. 1 depicts an exemplary embodiment of the present invention incorporating the magnetic embodiments. In this drawing, three book sections 30A, 30B, and 30C are encompassed within a book cover 10A. In this embodiment, a magnetically adhering cover member 17 is located along the spine of the book cover 15A and will engage the complimentary magnetically-adhering section member 37A, 37B, and 37C, which is located along the spine region of each book section 35A, 35B, and 35C.

Figure 4:
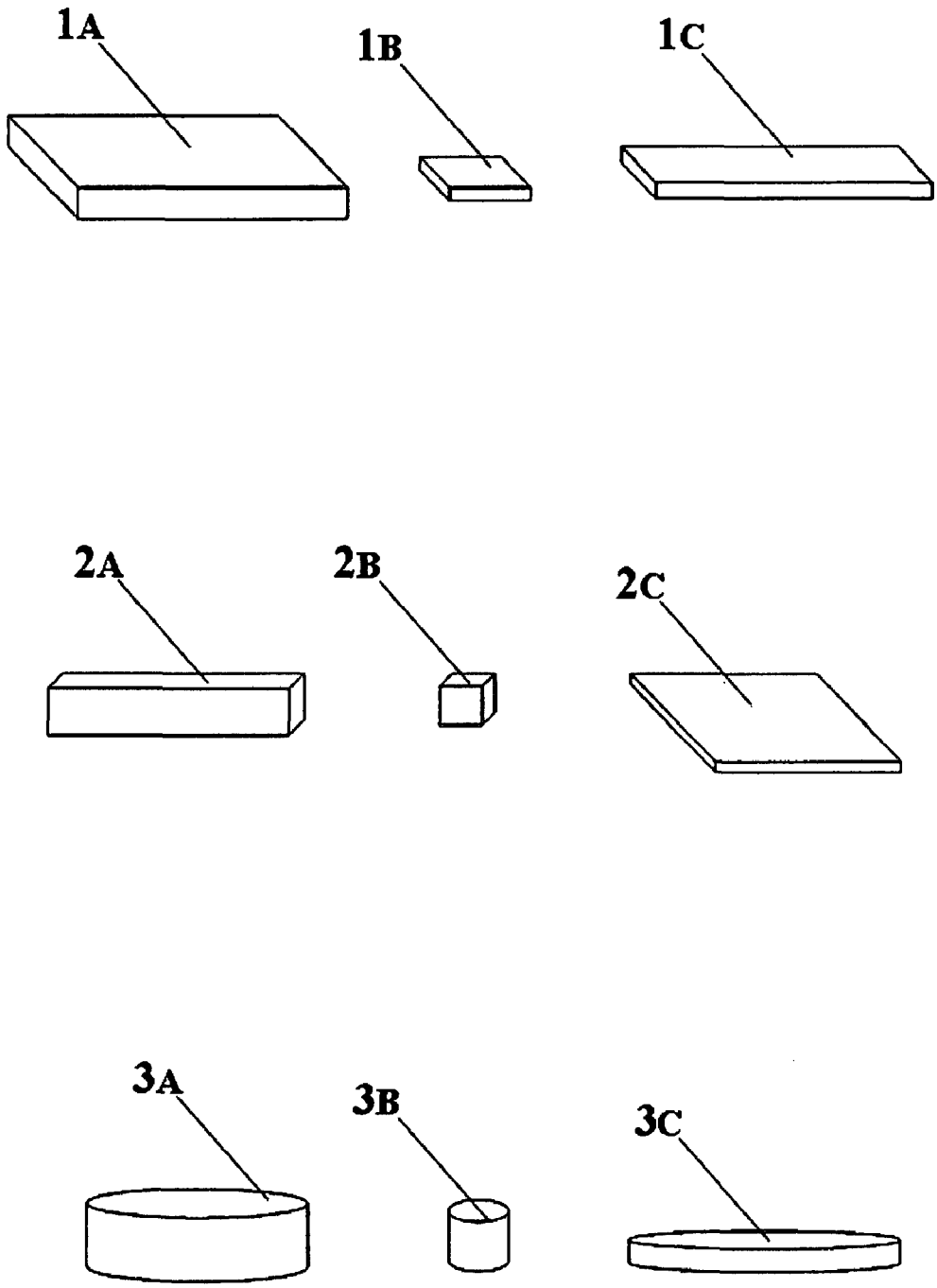
FIG. 4 shows magnetically-adhering members of varying sizes and shapes, according to an exemplary embodiment of the present invention.

FIG. 4 shows examples of magnetically-adhering of varying sizes and shapes. These magnetically-adhering members may be placed along the spine of the book cover 15A and/or the spines of the book sections 35A, 35B, and 35C as the magnetically-adhering members 17 or 37A, 37B, and 37C, respectively, for the following magnetic embodiments. The variety of the magnetically-adhering members include cylindrical, disc, cube, and rectangular shapes of materials with magnetic properties.

Figure 5:
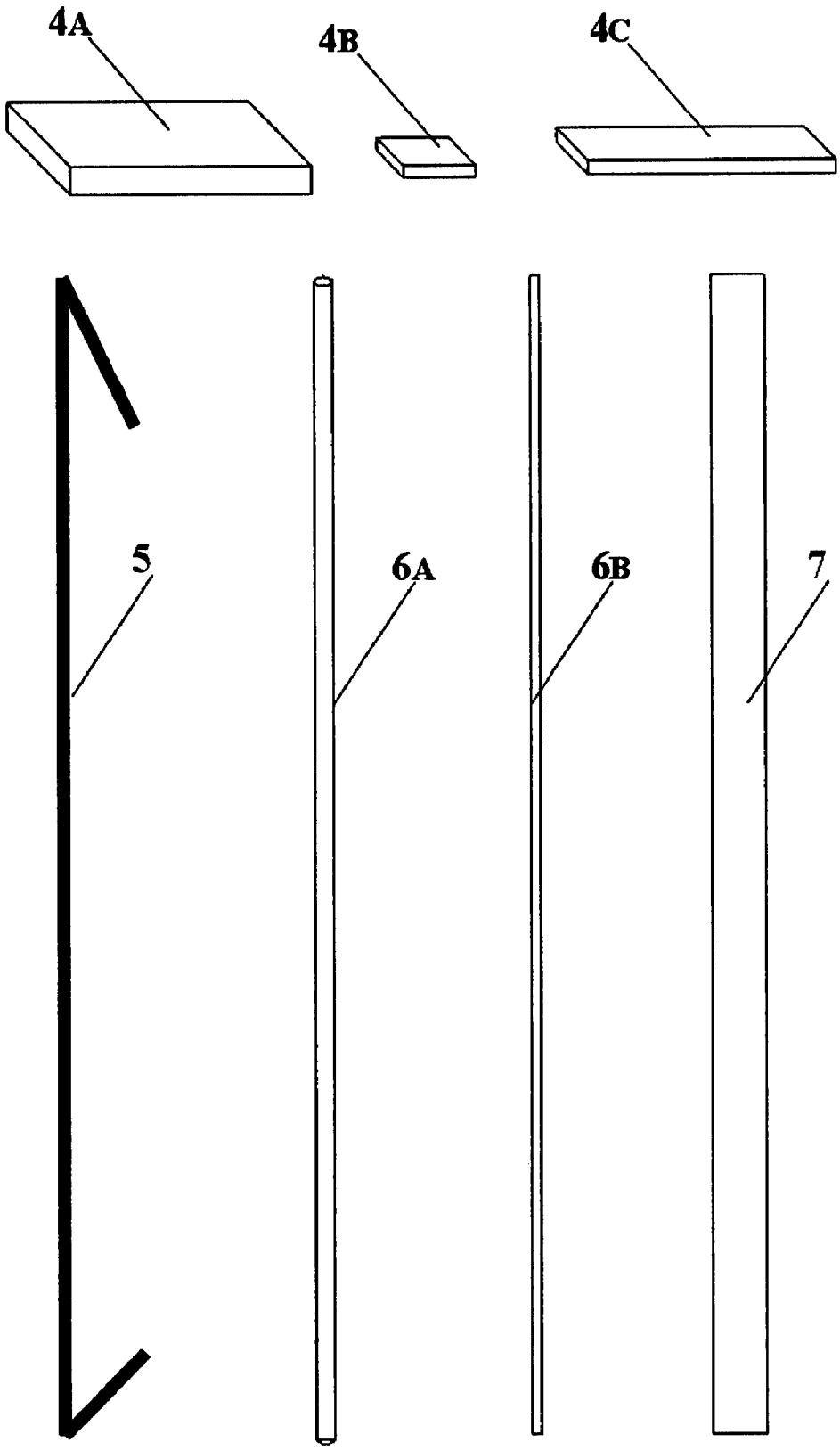
FIG. 5 shows magnetically-adhering and mechanically-attaching members of varying sizes and shapes, according to an exemplary embodiment of the present invention.

FIG. 5 shows additional magnetically-adhering members of varying sizes and shapes. These magnetically-adhering members may be placed along the spine of the book cover 15A and/or the spines of the book sections 35A, 35B, and 35C as the magnetically-adhering members 17 or 37A, 37B, and 37C, respectively, for the following magnetic embodiments. The variety of the magnetically-adhering members include rectangular, rod, and strip shapes of materials with magnetic and/or metallic properties.

Figure 3:
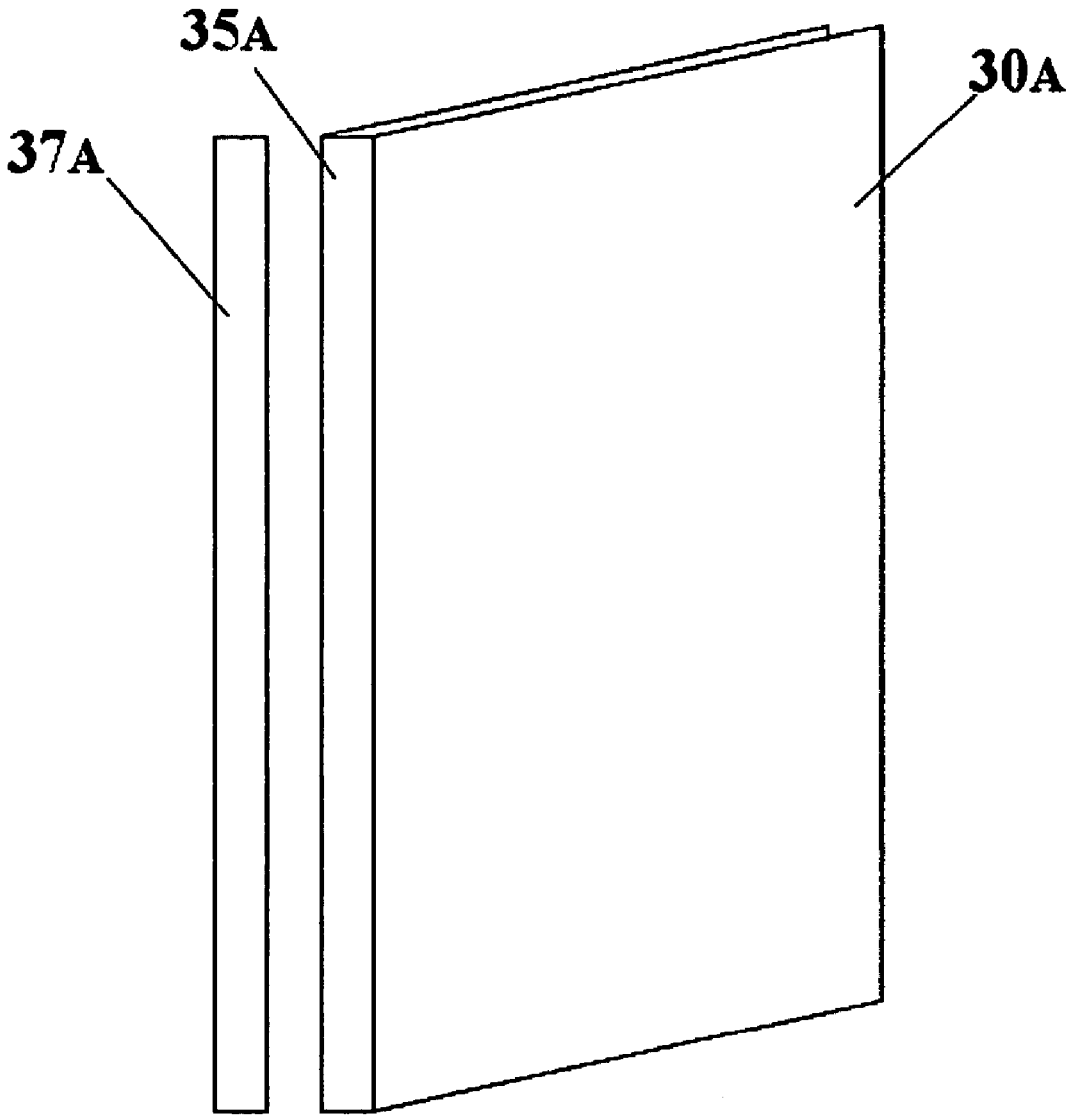
FIG. 3 is an exploded view of one method of incorporating a magnet or metal as the magnetically-adhering cover member into a book cover, according to an exemplary embodiment of the present invention.

FIG. 3 is a perspective view of one method of incorporating a magnetically-adhering section member 37A into a book section 30A along its spine 35A. A magnetically-adhering cover member 37A is affixed to the spine region 35A of a book section 30A by a variety of techniques, such as gluing, sewing, or crimping.

The magnetically-adhering section member 37A described in FIG. 3 serves as a placeholder for a material or variety of materials that can fill this area as a magnetically-adhering cover member, such as those depicted in FIG. 4 and FIG. 5. The following are examples of materials that can be used to fill the area.

Metal section member-I. In one embodiment, a natural or synthetic adhesive includes metal additives, such as fine powder. The metal additives or powder have properties which cause the adhesive mixture to be attracted to magnetic material. This composition base of the adhesive may include but is not limited to a polyvinyl acetate (PVA), resin, ground animal, ground hide, liquid hide, or caoutchouc (raw rubber). The adhesive with metal additives may be used in the binding of the book sections 30A, 30B, and 30C, serving as the magnetically-adhering members 37A, 37B, and 37C, respectively.

Metal section member-II. In an additional embodiment, a metal material (or plurality therein), may be incorporated into the composition of a tape. This tape with metallic parts would likely help to bind the book sections 30A, 30B, and 30C and would serve as the magnetically-adhering members 37A, 37B, and 37C, respectively.

Metal section member-III. In another embodiment, a metal section member may be manufactured by incorporating a material with metallic properties (or plurality therein) into the spine region of the book section. The form of the metal material may include but is not limited to a rod, block, strip or sheet structure, or a plurality therein. The metal material can be incorporated by various methods, such as gluing, sewing, or crimping the material over the book section.

Magnetic section member-I. A fourth embodiment of the section member uses a natural or synthetic adhesive with materials with magnetic properties. These magnetic materials may include fine magnets such as powder or a material that can be altered to be attracted to a magnetic force. This composition base of the adhesive may include but is not limited to a polyvinyl acetate (PVA), resin, ground animal, ground hide, liquid hide, or caoutchouc (raw rubber). The adhesive with magnetic additives may be used in the binding of the book sections 30A, 30B, and 30C, serving as the magnetically-adhering members 37A, 37B, and 37C, respectively.

Magnetic section member-II. In an additional embodiment, a magnetic material (or plurality therein) may be incorporated into the composition of a tape. This tape with magnetic parts would likely help to bind the book sections 30A, 30B, and 30C and would serve as the magnetically-adhering members 37A, 37B, and 37C, respectively.

Magnetic section member-III. In yet another embodiment, a material with magnetic properties (or plurality therein) of sufficient strength, width, and flexibility is adhered to the spine of the book section. Although other ways to adhere the magnet to the section members 30A, 30B, and 30C can be used, an example would be to attach the magnet to the book section in an adhesive fashion. This magnet spine would serve as the magnetically-adhering members 37A, 37B, and 37C, respectively.

Figure 2:
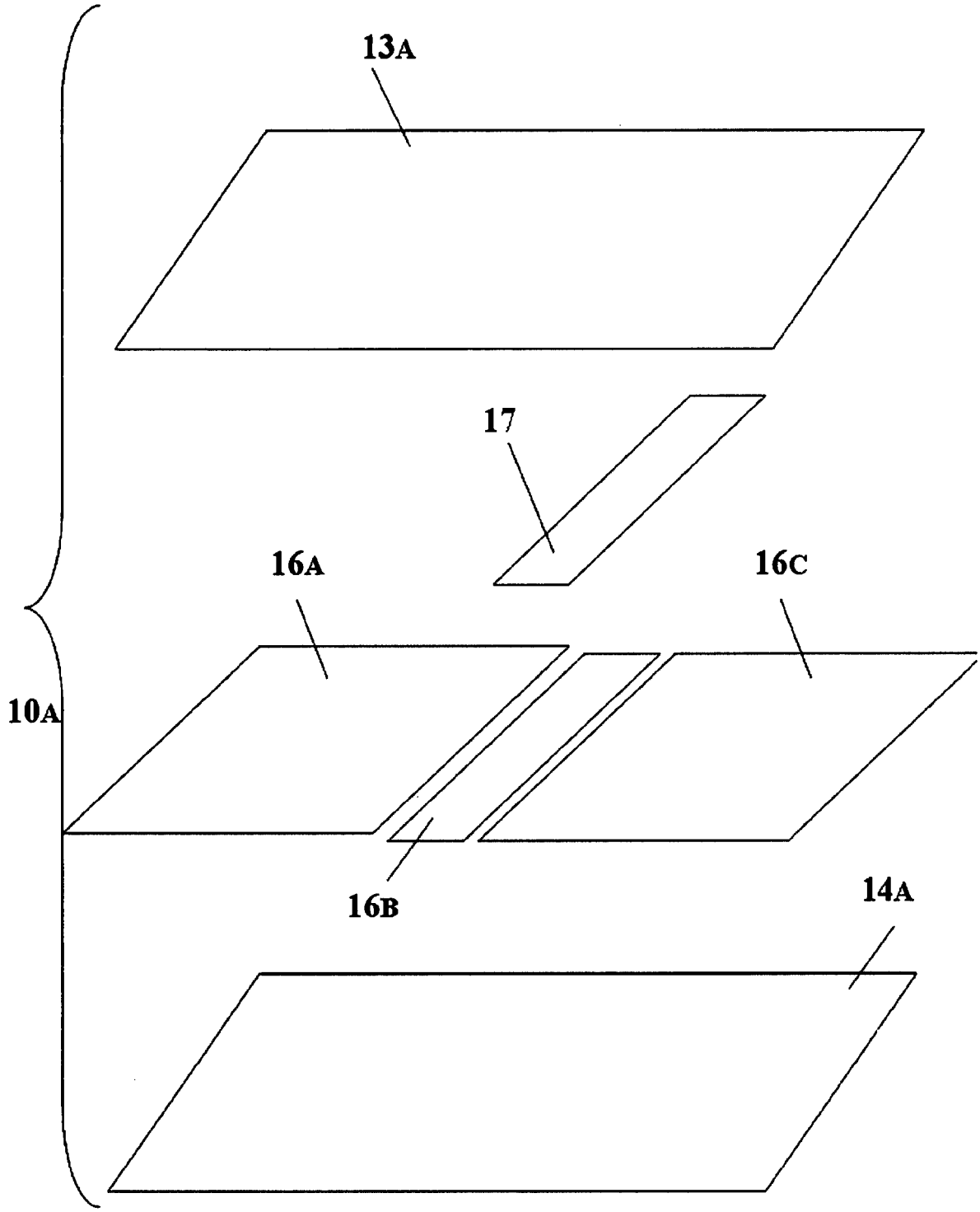
FIG. 2 is an exploded view of one technique of incorporating a magnet or metal as the magnetically-adhering cover member into a book cover, according to an exemplary embodiment of the present invention.

FIG. 2 is an exploded view of one method of incorporating a magnetically-adhering cover member 17 into a book cover 10A. A magnetically-adhering cover member 17 is enclosed into the spine region of a book cover 10A by the cover inner layer 13A, for example a paper stock, and the cover outer layer 14A, such as a leather-like material. In this example, the cover is strengthened by the relatively thick cover boards 16A, 16B, and 16C, which are also enclosed into the cover by the outer 14A and inner 13A cover layers. The support for the book cover's spine region 16C is optional and can be made of a different weight stock than the other cover board(s).

The magnetically-adhering cover member 17 described in FIG. 2 serves as a placeholder for a material or variety of materials that can fill this area as a magnetically-adhering cover member, such as those depicted in FIG. 4 and FIG. 5. The below presents examples of materials that can be used to fill the area.

Metal book member-I. In one embodiment, a natural or synthetic adhesive includes metal additives, such as fine powder. The metal additives or powder have properties which cause the adhesive mixture to be attracted to magnetic material. This composition base of the adhesive may include but is not limited to a polyvinyl acetate (PVA), resin, ground animal, ground hide, liquid hide, or caoutchouc (raw rubber). The adhesive with metal additives may be used in the manufacture of the book cover, serving as the magnetically-adhering member 17 of the book cover 10A.

Metal book member-II. In an additional embodiment, a metal material (or plurality therein) may be incorporated into the composition of a paper-based material. The board with metallic parts would be used at least in part for the book cover board and would serve as the magnetically-adhering member 17 for the book cover 10A.

Metal book member-III. In another embodiment, a metal section member may be manufactured by incorporating a material with metal properties (or plurality therein) into the spine region of the book cover. The form of the metal material may include but is not limited to a rod, block, or sheet structure, or a plurality therein. The metal material can be incorporated by various methods, such as gluing, sewing, or crimping the material over the book cover. This metal material would serve as the magnetically-adhering member 17 for the book cover 10A.

Magnetic book member-I. A third embodiment of the book cover uses a natural or synthetic adhesive with materials with magnetic properties. The magnetic materials may include fine magnets such as powder or a material that can be altered to be attracted to a magnetic force. This composition base of the adhesive may include but is not limited to a polyvinyl acetate (PVA), resin, ground animal, ground hide, liquid hide, or caoutchouc (raw rubber). The adhesive with magnetic additives may be used in the manufacture of the book cover, serving as the magnetically-adhering member 17 of the book cover 10A.

Magnetic book member-II. In an additional embodiment, a magnetic material (or plurality therein) may be incorporated into the composition of a paper-based material. The board with magnetic parts would be used at least in part for the book cover board and would serve as the magnetically-adhering member 17 for the book cover 10A.

Magnetic book member-III. In yet another embodiment, a material with magnetic properties (or plurality therein) of sufficient strength, width, and flexibility is adhered to the spine of the book cover. Although other ways to adhere the magnet to the section member can be used, an example would be to attach the magnet to the book section in an adhesive fashion. This magnet material would serve as the magnetically-adhering member 17 for the book cover 10A.

The following is a list of mechanical embodiments of the present invention. The book sections 30A, 30B, and 30C can be attached to the book cover 10A through adjoining members. Combinations of attaching the book section 30A, 30B, and 30C and book cover 10A by adjoining members include but are not limited to (i) concavity-convexity interlocking parts, (ii) convexity-concavity interlocking parts, (iii) opening-rivet, (iv) hook-and-loop, (v) clamping, and (vi) clipping mechanisms.

Interlocking section member. In one embodiment, the section member would be independently bound. The spine region of the section member may then be manipulated or further molded so that it will have a concavity and/or convexity (or plurality therein) that fits into a complimentary part of the book cover.

Interlocking book member. As a compliment to the section member described in the interlocking section member embodiment, the book cover would be fashioned to include a concavity and/or convexity (or plurality therein) that fits into a complimentary part of the book section.

Figure 6:
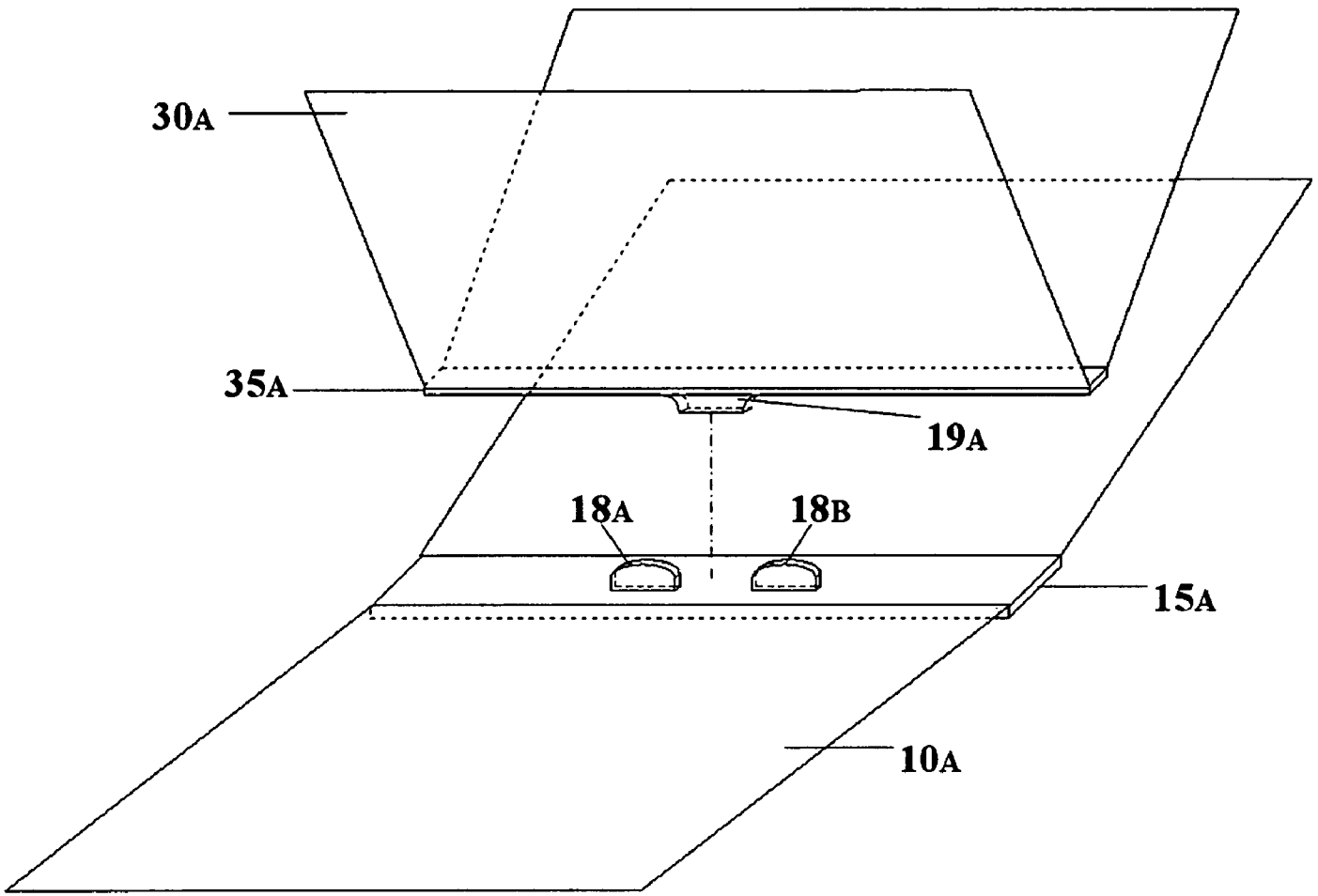
FIG. 6 is a perspective view of a book with interlocking book sections and book cover, according to an exemplary embodiment of the present invention.

FIG. 6 depicts an interlocking mechanism between a book cover 10A and book section 30A. In this embodiment, there is a unique convexity 19A along the exterior of the spine region 35A of the book section 30A. Complimentary convexities 18A and 18B are placed along the interior of the spine region 15A of the book cover 10A. This arrangement of convexities will allow the book section 30A to attach and be retained by the book cover 10A.

Figure 7A:
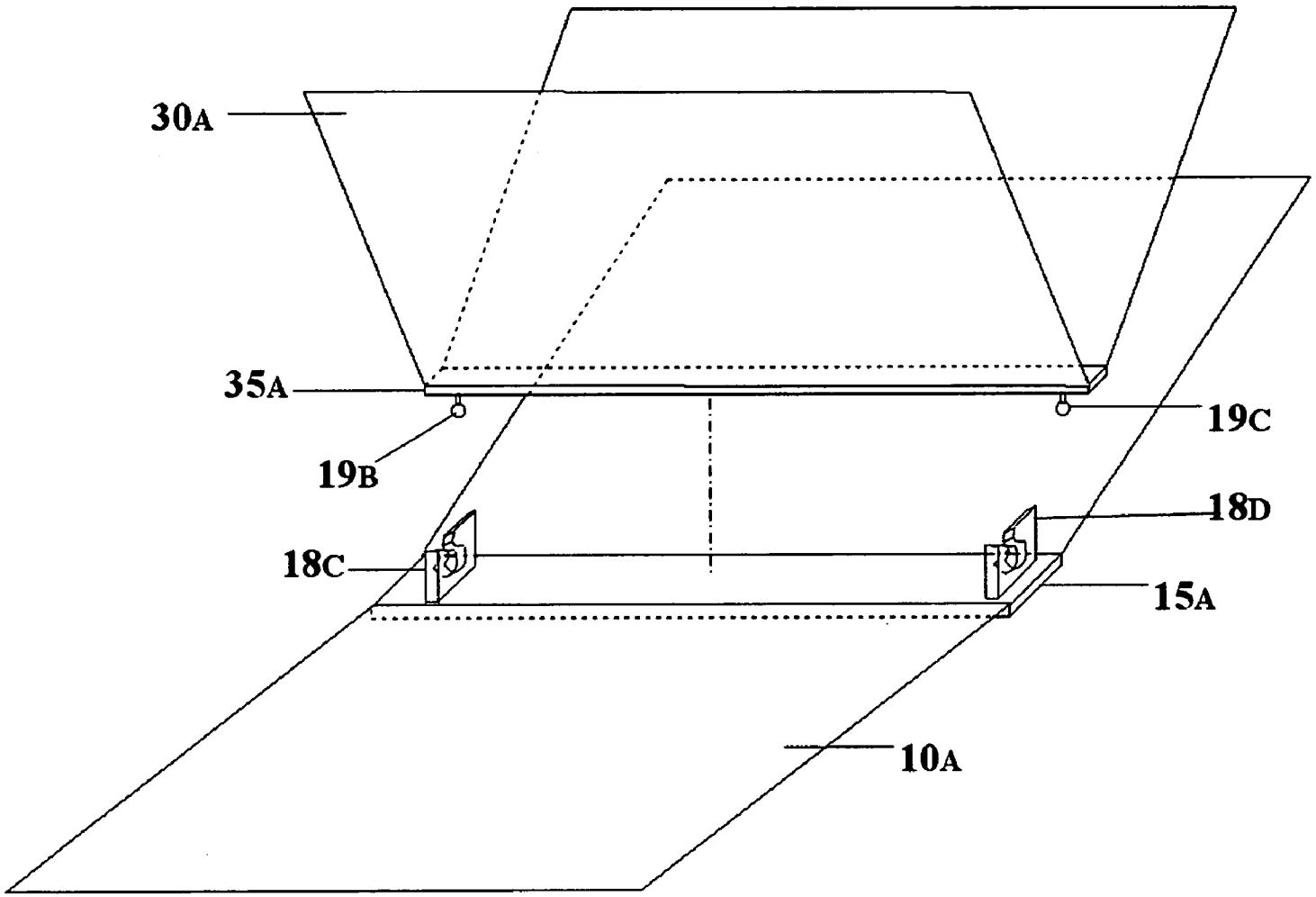
FIG. 7A is a perspective view of an alternative version of interlocking book sections and book cover, with convexities along the book section's spine and complimentary concavities in the book cover, according to an exemplary embodiment of the present invention.
Figure 7B:
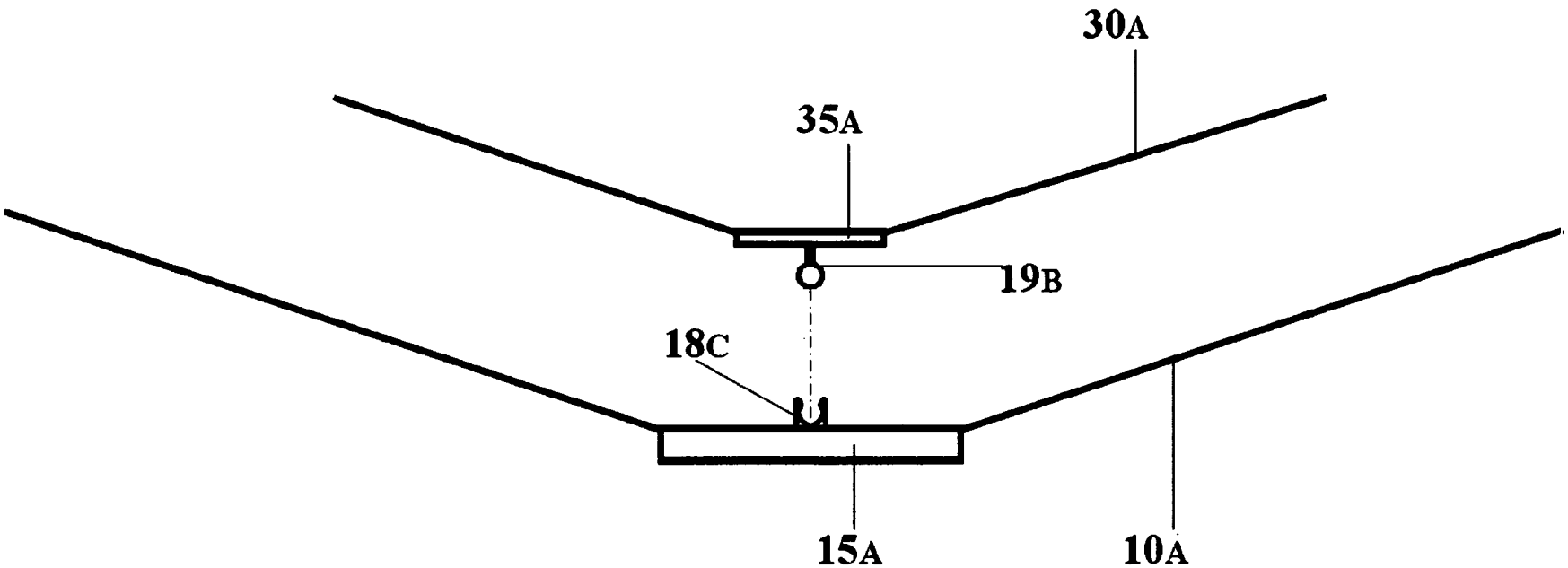
FIG. 7B is an alternative view of FIG. 7A.

FIGS. 7A and 7B depict another mechanical embodiment using interlocking convexity and concavity members. In these drawings, unique convexities 19B and 19C are placed along the exterior of the spine region 35A of the book section 30A. Complimentary convexities 18C and 18D are placed along the interior of the spine region 15A of the book cover 10A. This arrangement of convexities will allow the book section 30A to attach and be retained by the book cover 10A.

Figure 8A:
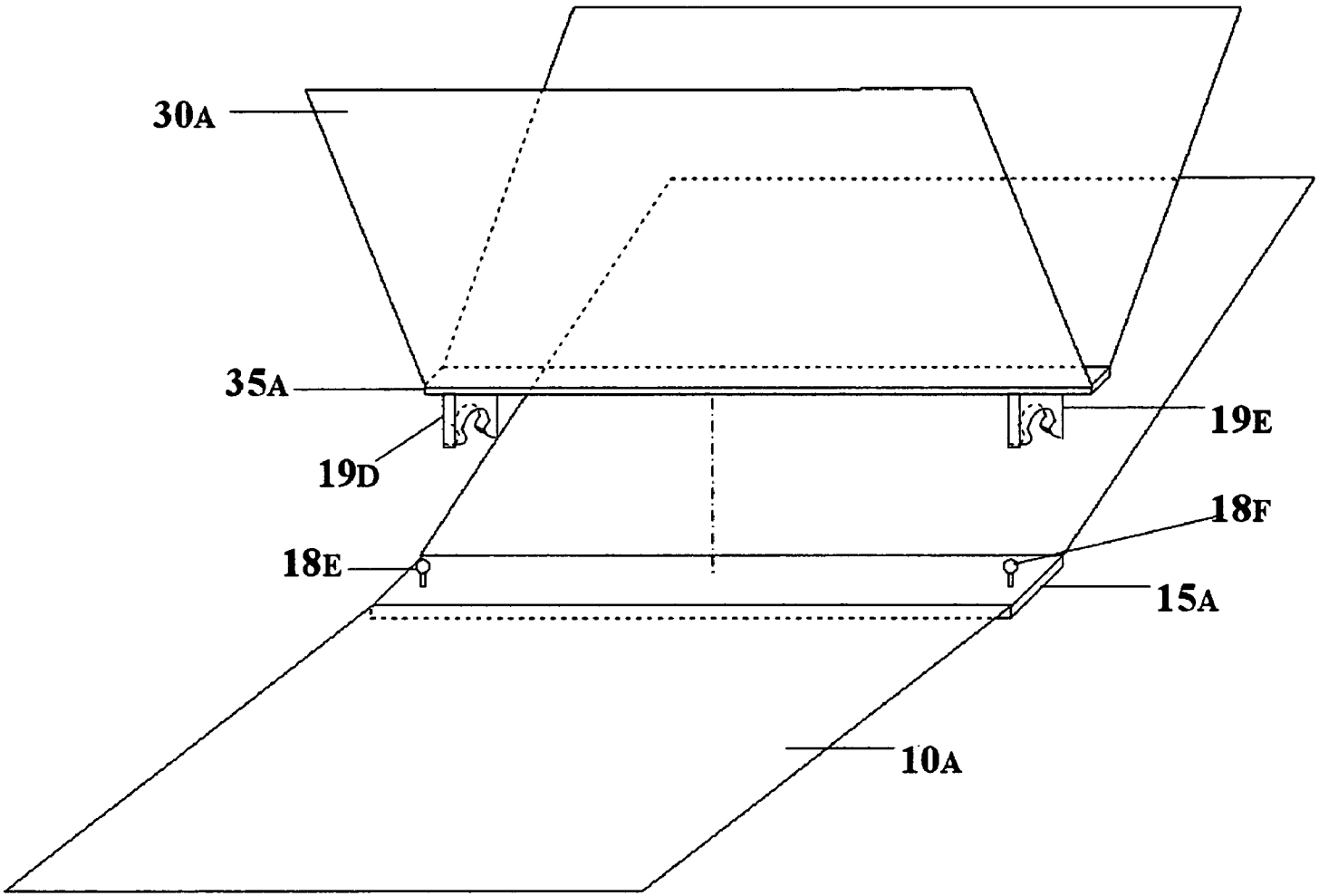
FIG. 8A is a perspective view of an alternative version of interlocking book sections and book cover, with concavities along the book section's spine and complimentary convexities in the book cover, according to an exemplary embodiment of the present invention.
Figure 8B:
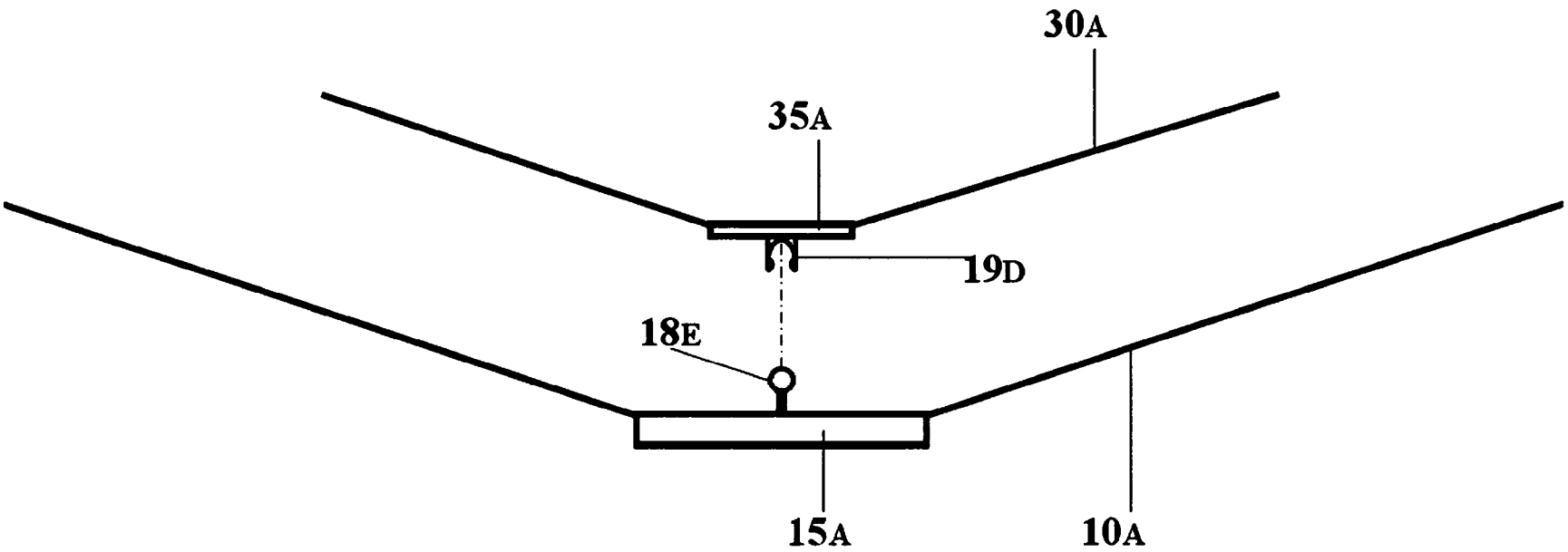
FIG. 8B is an alternative view of FIG. 8A.

FIGS. 8A and 8B depict another mechanical embodiment using interlocking convexity and concavity members. In these drawings, unique concavities 19D and 19E are placed along the exterior of the spine region 35A of the book section 30A. Complimentary convexities 18E and 18F are placed along the interior of the spine region 15A of the book cover 10A. This arrangement of convexities will allow the book section 30A to attach and be retained by the book cover 10A.

Rivet section member. In another mechanical embodiment, section members 30A, 30B, and 30C would be bound and include an opening (or plurality therein) in or near their spine regions 35A, 35B, and 35C. An exemplary fashion in which these section members are bound is through saddle stitching method, which employs staples to attach the pages of these book sections to each other. Openings, such as holes, would be punched in or around the spine regions 35A, 35B, and 35C. The opening(s) would allow a member of the book cover 10A to be attached by in a way other than a binder apparatus, which is widely used for business and school use already.

Rivet book member. As a compliment to the section member described in the rivet section member embodiment, the book cover 10A would include an adjoining member that would attach the book sections 30A, 30B, and 30C to the book cover 10A through the opening(s) in the book sections 30A, 30B, and 30C. Examples of the adjoining member include rivets, clips (such as paper clips), and/or other materials which are flexible and durable enough to bend and attach the book section to the book cover.

Figure 9A:
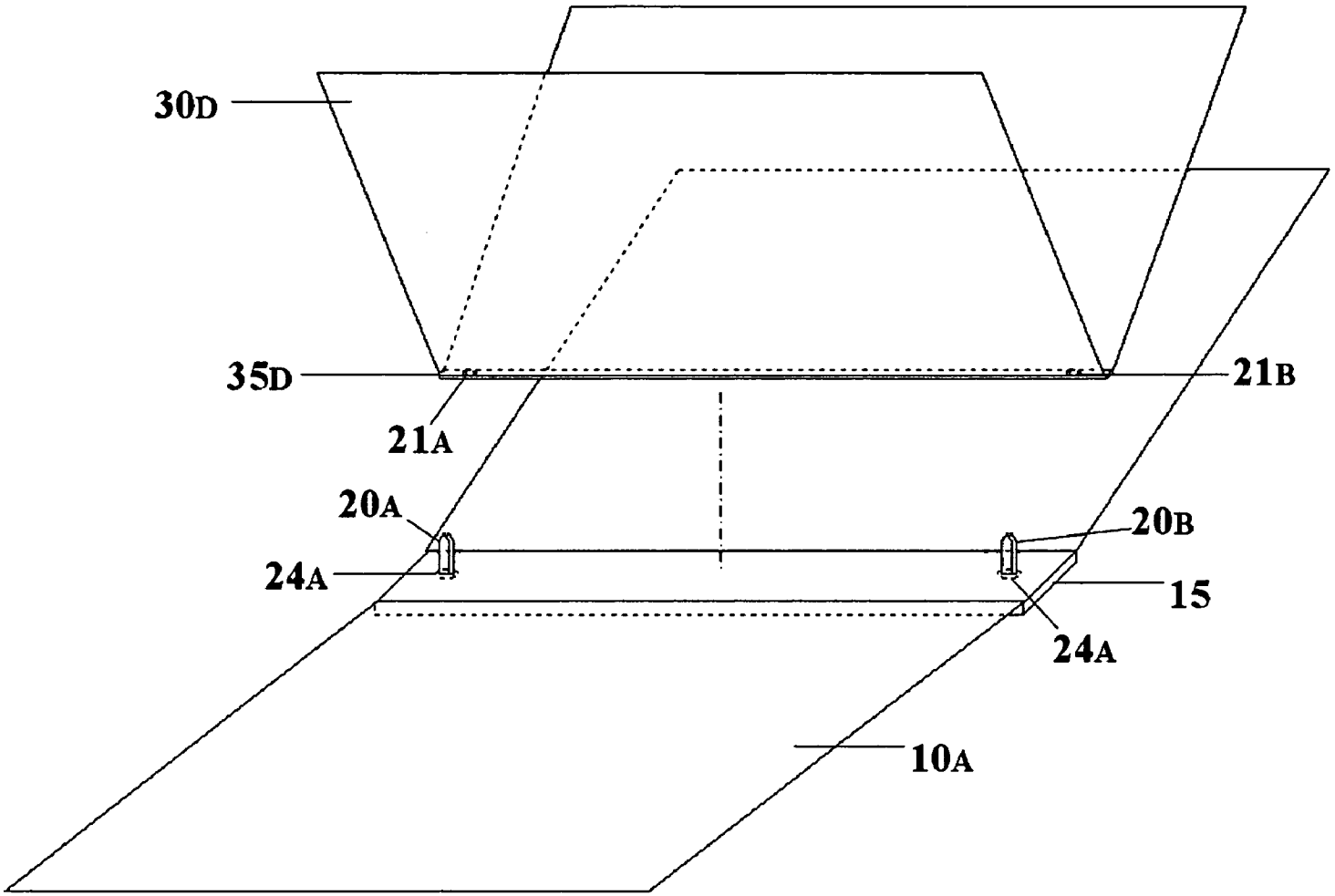
FIG. 9A is a perspective view of book section with openings in its spine and a book cover with complimentary rivets as the mechanically-attaching book member, according to an exemplary embodiment of the present invention.
Figure 9B:
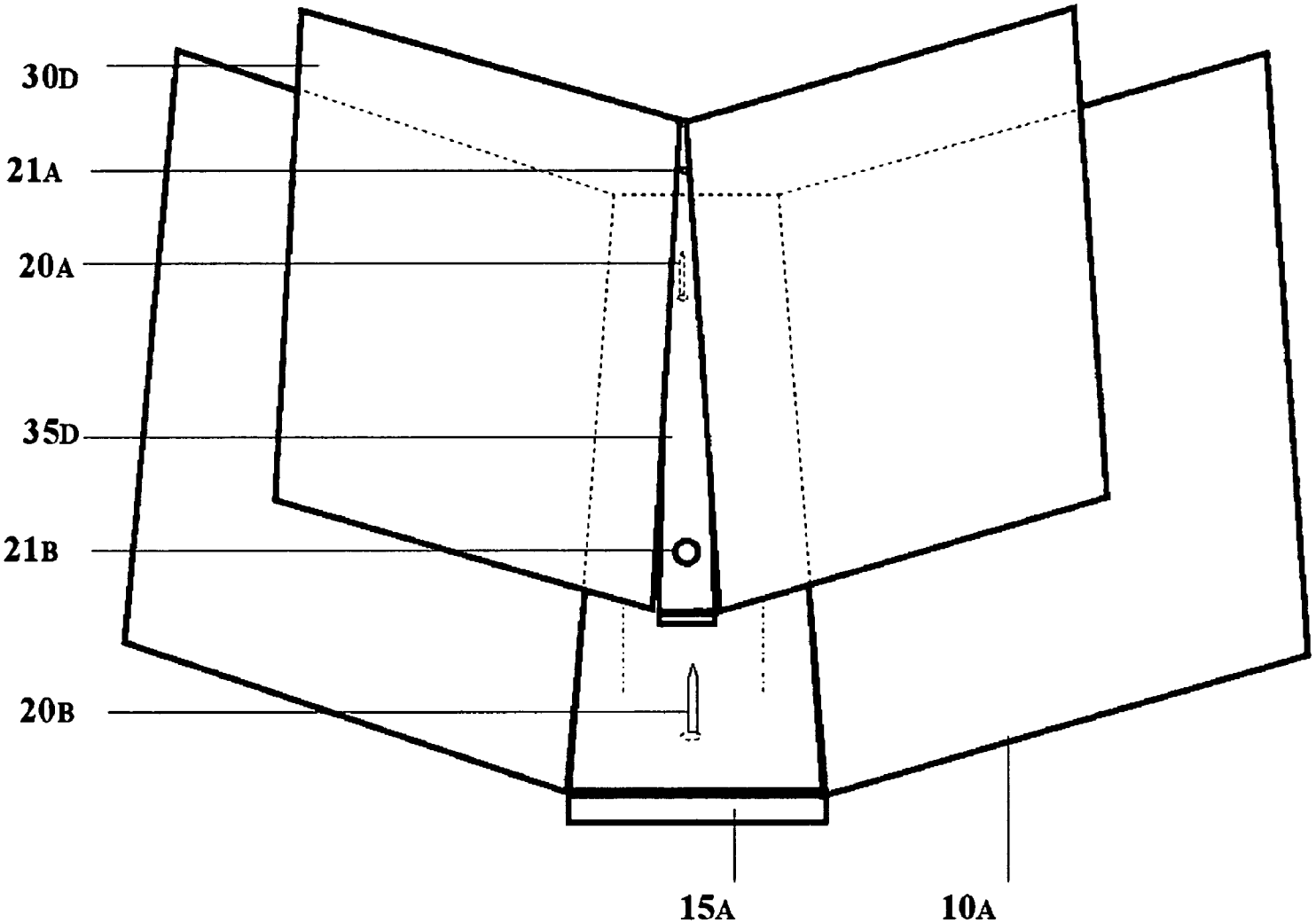
FIG. 9B is an alternative view of FIG. 9A.

FIGS. 9A and 9B shows book section 30A with small openings 21A and 21B along its spine of the book section 35A. There are rivets along the interior of the spine of the book cover 15A. The arms of these rivets 20A and 20B will connect to the openings 21A and 21B within the spine of the book section 35A.

Figure 9C:
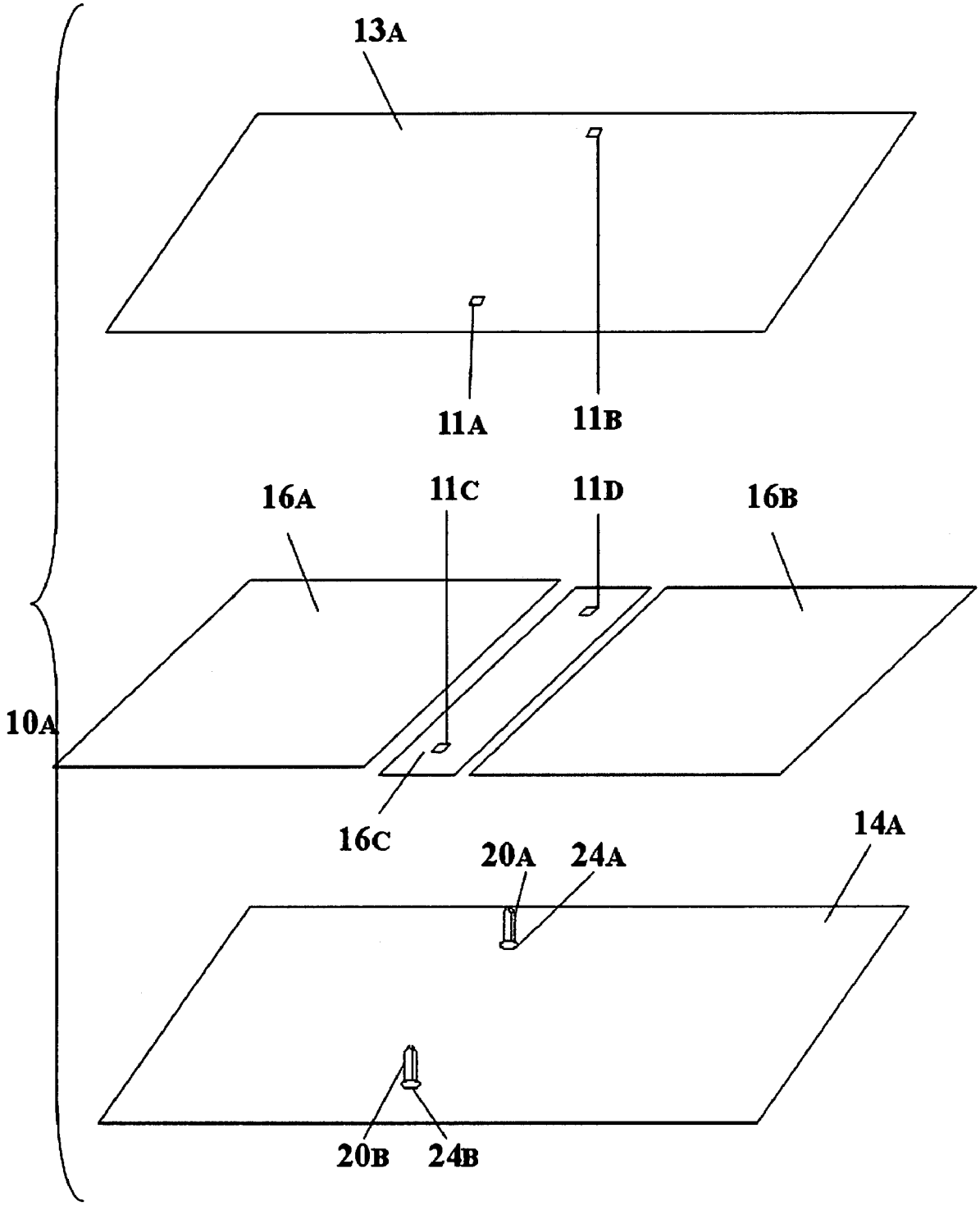
FIG. 9C is an exploded view of FIG. 9A.

An exemplary construction of this embodiment is depicted in FIG. 9C and encloses the heads of the rivets 24A and 24B within the spine of the book cover 15A. This embodiment may be manufactured by including small openings along the spine region 15A of the inner cover layer 13A of the book cover 10A through which the arms of these rivets 20A and 20B may extend. To create additional strength, the heads of these rivets 24A and 24B may be enclosed behind the support for the spine region of the book cover 16C. In this case, small openings through which the arms of these rivets 20A and 20B may extend also need to be included along the support for the spine region of the book cover 16C.

Hook and loop book section and book cover members. Using this embodiment, complimentary hook and loop material would be affixed to the book section and the book cover. The hook and loop material can be incorporated by various methods, such as gluing or sewing the material over the book section and the book cover.

Figure 10:
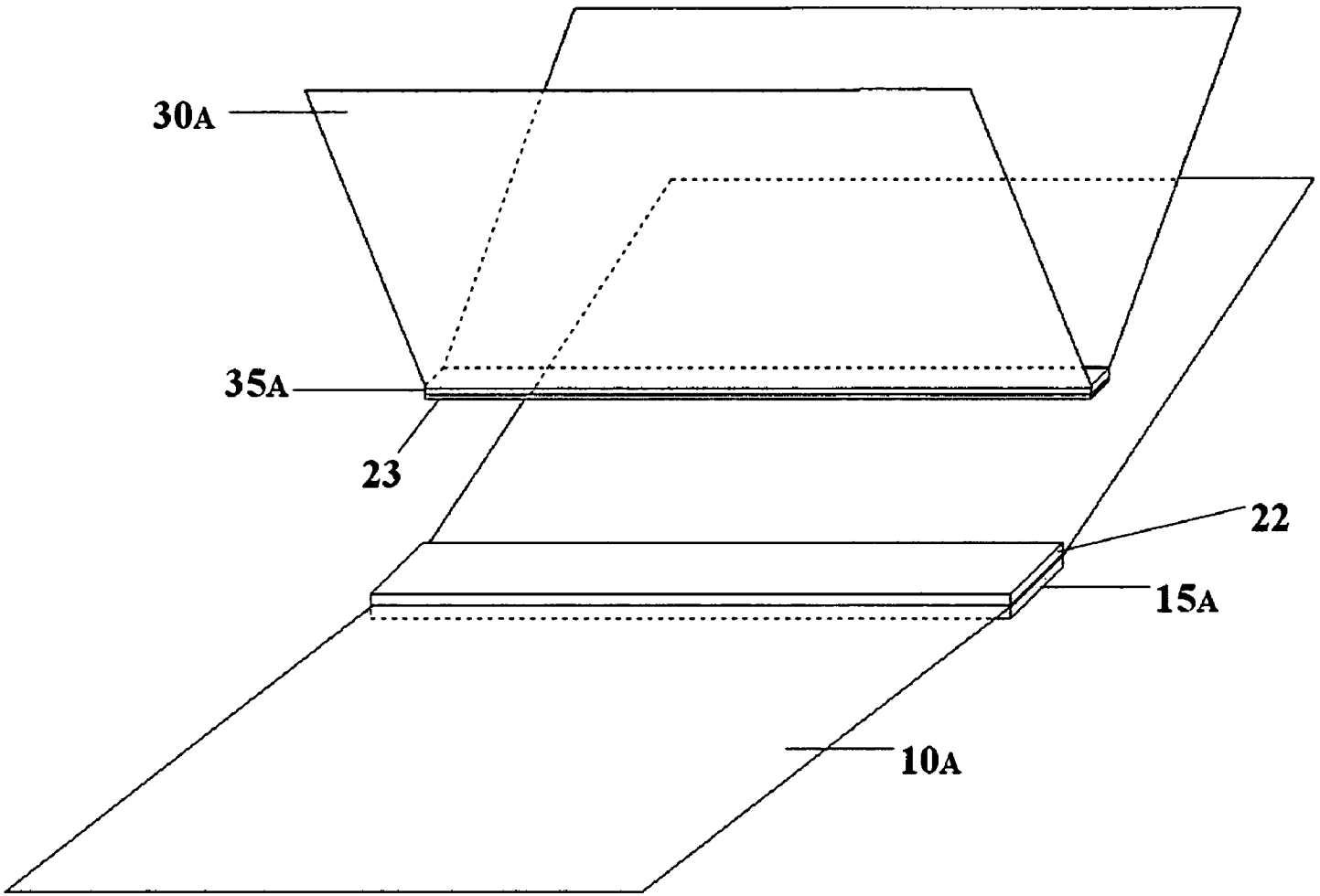
FIG. 10 is a perspective view of book sections and a book cover with complimentary hook and loop pieces along their spines, according to an exemplary embodiment of the present invention.

FIG. 10 depicts a hook and loop system of attaching the book section 30A to the book cover 10A. A hook and loop piece 23 is placed along the exterior of the spine region of the book section 35A. A complimentary hook and loop piece 22 is placed along the interior of the spine region of the book cover 15A. These hook and loop pieces may be applied in multiplicity along the spine region of the book section 35A and the spine of the book cover 15A as well. It is contemplated that an ideal form of attaching the these hook and loop (such as Velcro) pieces to the spine region of the book section 35A and the spine region of the book cover 15A will be in an adhesive fashion.

Clamp book member-I. In another mechanical embodiment, a clamp or series of clamps would bind the section members 30A, 30B, and 30C to the book cover 10A. The clamping mechanism would be placed along the interior of the spine region of the book cover 15A. These clamps may be composed of Acco® clips that have the opening of the clip towards the interior of the book cover and the clamping mechanism along the exterior of the book cover.

Figure 11A:
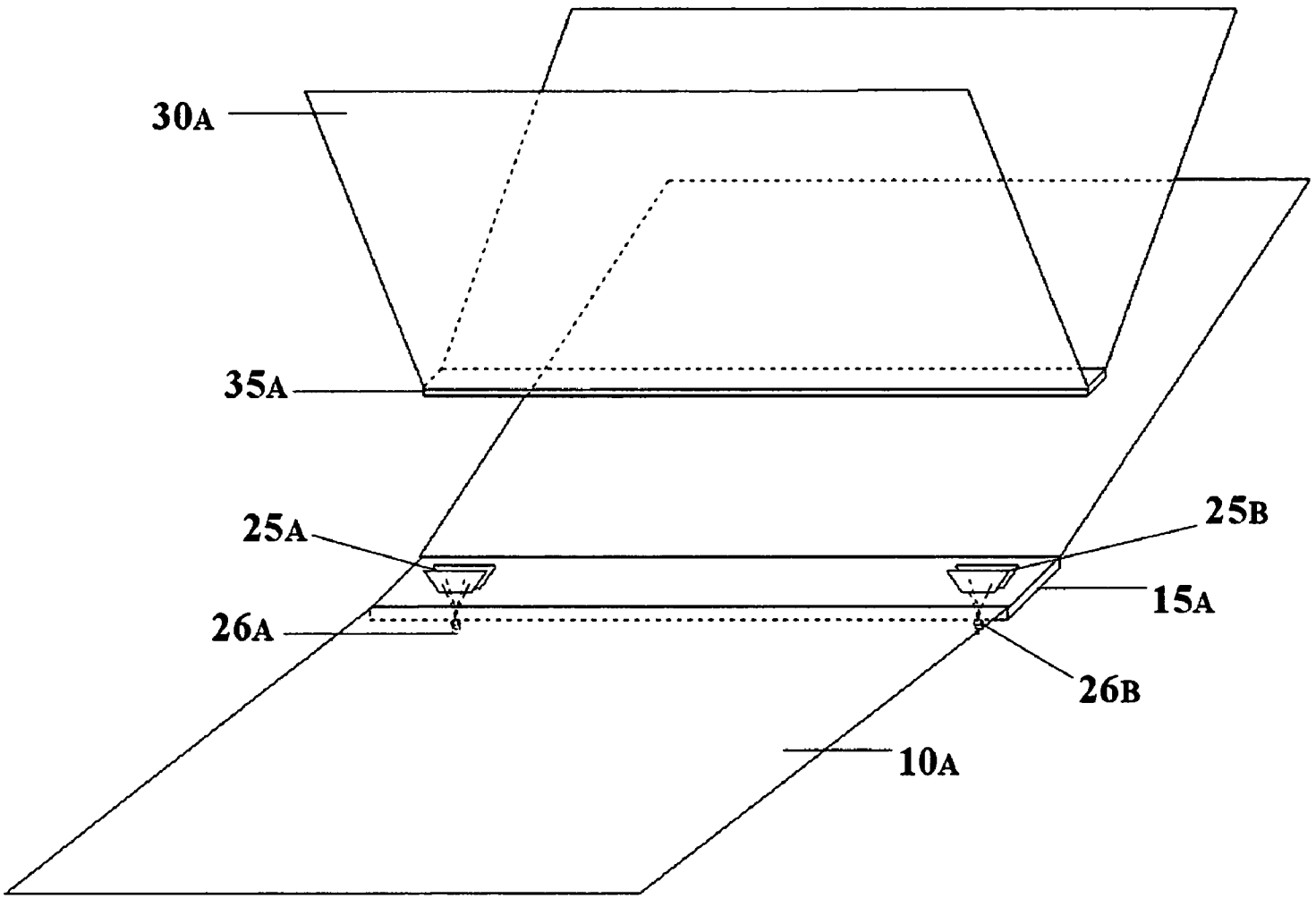
FIG. 11A is a perspective view of a book cover incorporating clips along the interior of its spine, according to an exemplary embodiment of the present invention.

FIG. 11A shows the use of clamps to attach the book section 30A to the book cover 10A. A series of clamps 25A and 25B are placed along the interior of the spine region of the book cover 15A. The user can capture and release the book section 30A by applying and releasing pressure on the lever-ends of the clamps 26A and 26B, which can be accessed on the exterior of the book cover (10).

Figure 11B:
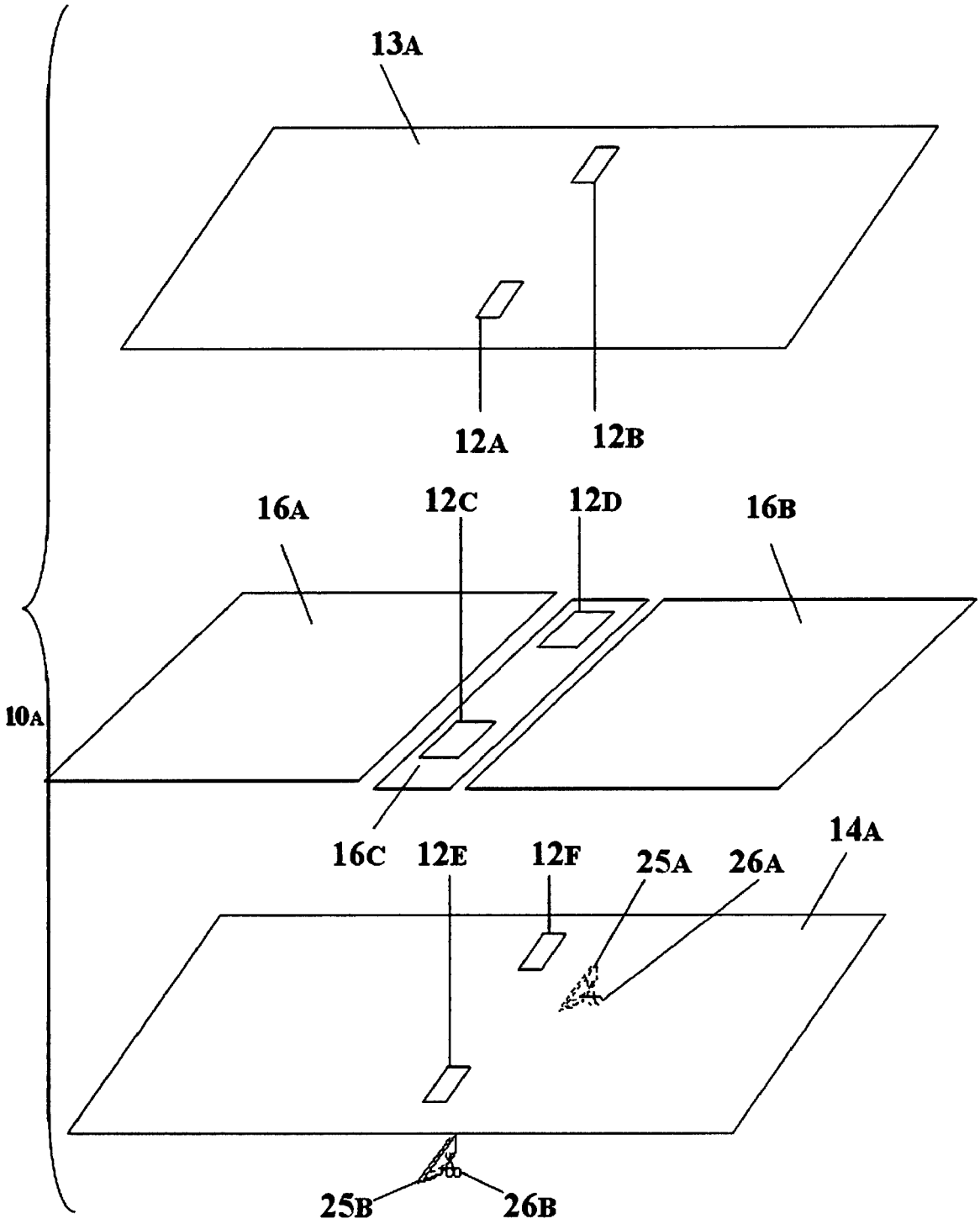
FIG. 11B is an exploded view of FIG. 11A.

An exemplary construction of this embodiment is depicted in FIG. 11B and exposes the lever-ends of the clamps 26A and 26B on the exterior of the spine region of the book cover 15A. This embodiment may be manufactured by including small openings along the spine region 15A of the inner cover layer 13A of the book cover 10A through which the clamps 25A and 25B may extend. To access the lever-ends of the clamps 26A and 26B, additional openings must be created along the support 16C for the spine region of the book cover 15A as well as the outer cover layer 14A of the book cover 10A.

Clamp book member-II. In another mechanical embodiment, a clamp or series of clamps would bind the section members to the book cover. The clamping mechanism would be enclosed along the interior of the spine of the book cover. This clamping mechanism would include a lever and a series of rods that would raise and lower, according to the movement of the lever. The clamping mechanism would serve as the adjoining member of the book cover and would capture and retain the book sections.

Figure 12:
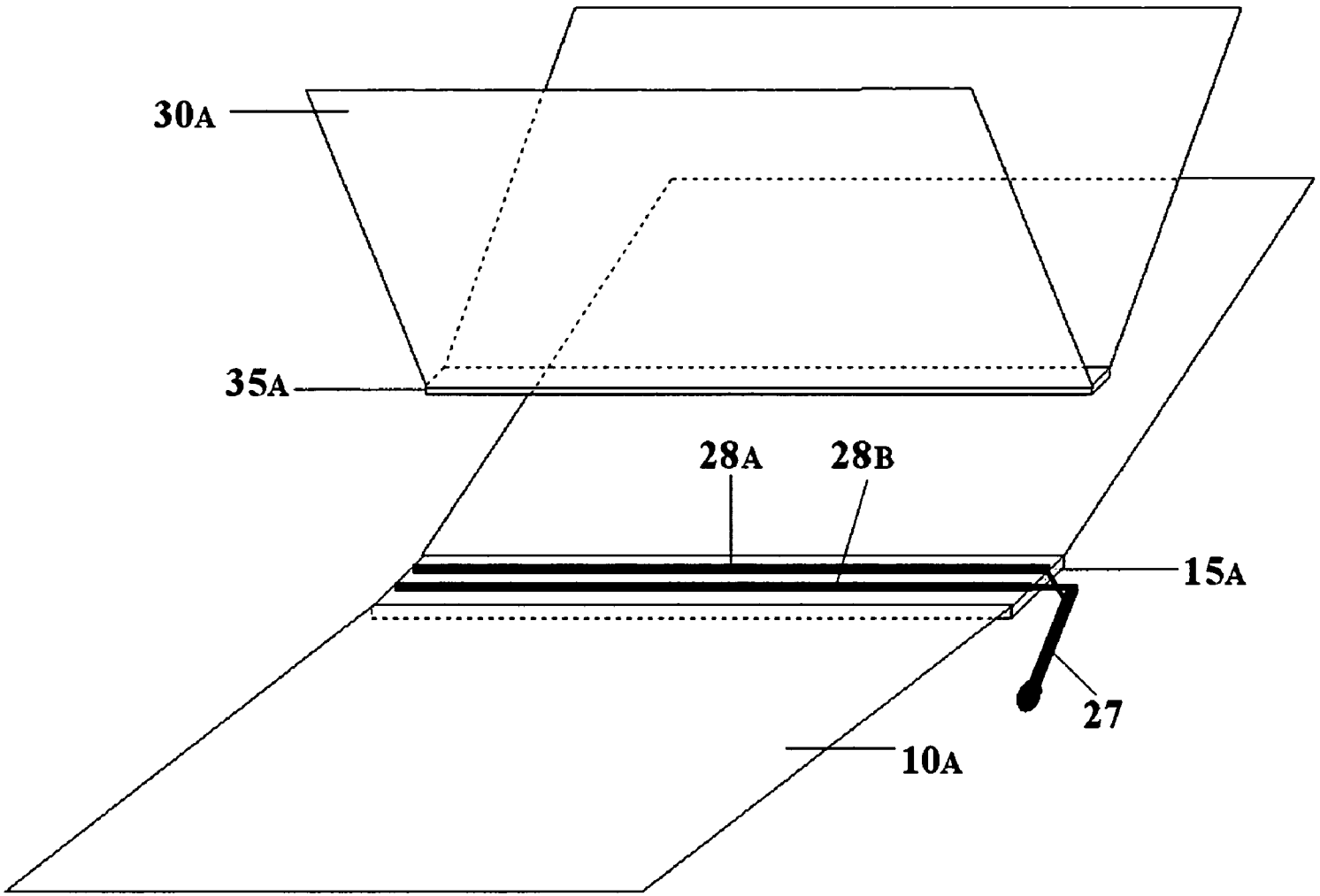
FIG. 12 is a perspective view of a book cover incorporating a clamping mechanism along the interior of its spine, according to an exemplary embodiment of the present invention.

FIG. 12 depicts a clamping mechanism that uses a lever 27 to raise and lower a series of durable rods 28A and 28B. As the user manipulates lever 27 and the rods 28A and 28B raise, the book section 30A will be captured and retained by the book cover 10A. When the lever 27 is moved in an alternative direction, the rods 28A and 28B lower and release pressure on the book section 30A, allowing the book section 30A to be removed from the book cover 10A. The clamping mechanism may be attached to the interior of the spine of the book cover 15A in a sewing, clamping, clipping, and/or adhesive fashion.

Clip book member-I. In an additional mechanical embodiment, a rod (or plurality therein) would bend and clip the book sections to the book cover. The materials used in this embodiment include a flexible and durable rods (such as those made of a plastic and/or rubber and/or metal materials), which would be attached to the book cover. The rods may be attached in a variety of ways, such as gluing, sewing, or crimping. The rods may be placed in a variety of regions throughout the spine of the book section, such as along the head and foot of the book cover or in and around the middle of the book cover.

Figure 13:
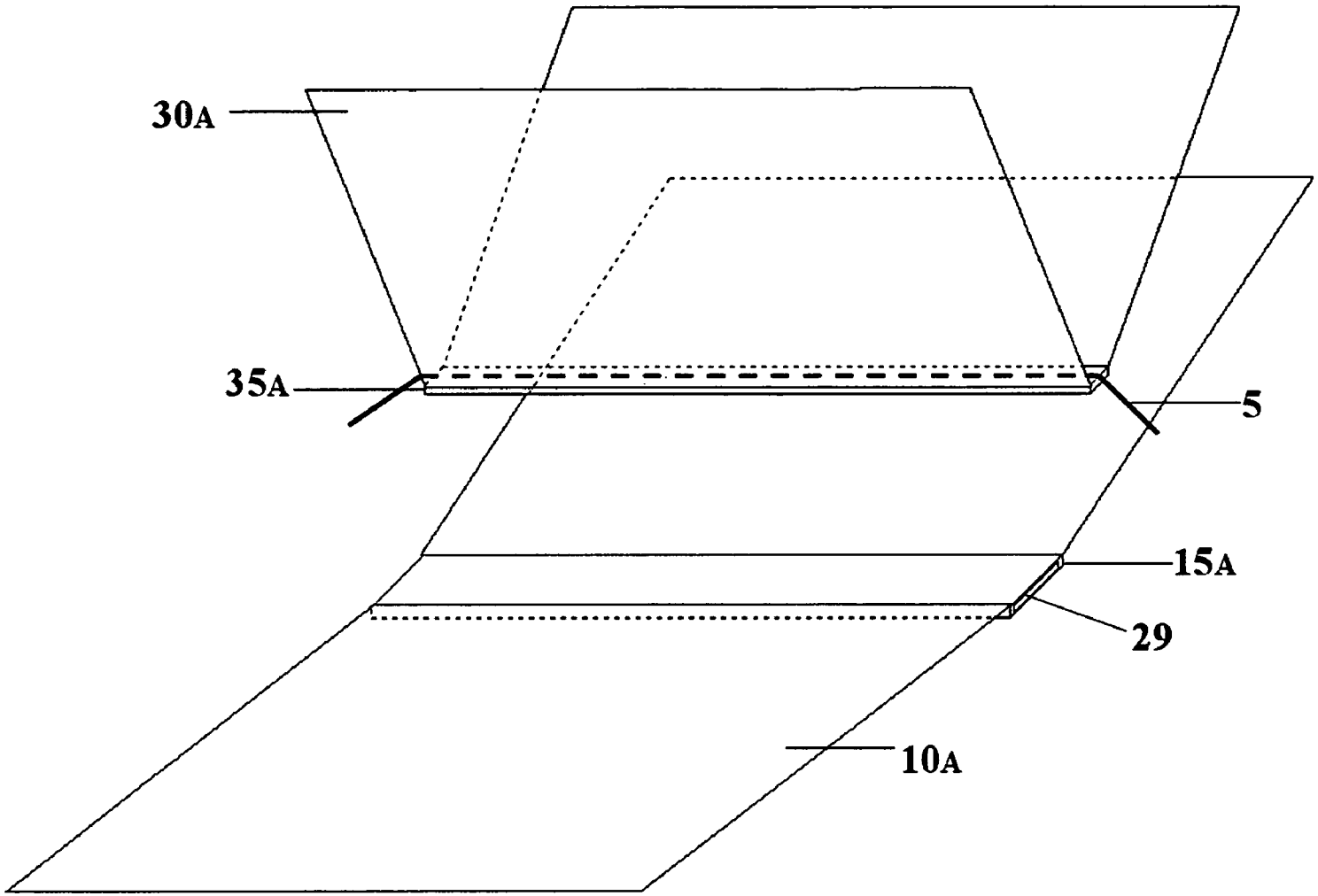
FIG. 13 is a perspective view of a mechanically-attaching embodiment using a book section with flexible, durable rods along the spine of book section and a void along the width of book cover, according to an exemplary embodiment of the present invention.

FIG. 13 shows a flexible, durable rod 5 attached to the spine of the book section 35A. This rod 5 bends and attaches to the exterior the book cover 10A or through the opening 29 along the width of the spine region of the book cover 15A. Although this drawing shows the rod 5 extending the entire length of the spine region of the book section 35A, a rod may be placed along the head and/or foot of the spine region of the book section 35A and have the same effect. The rod 5 may be attached along the interior or exterior of the spine region of the book section 35A by a variety of ways, including but not limited to gluing, taping, sewing, clamping, or crimping. The ideal construction for this embodiment is contemplated to have one rod 5 that extends beyond the head and foot of the spine region of book section 35A and that attached to the interior of the spine region of the book section 35A. The adhesive that binds the section's book block to the cover of the book section may also help to keep the rod 5 in place and add extra strength to its design.

Clip book member-II. In a different mechanical embodiment, a rod (or plurality therein) would bend and clip the book sections to the book cover. The materials used in this embodiment include a flexible and durable rods (such as those made of a plastic and/or rubber and/or metal materials), which would be attached to the book cover. The rods may be attached in a variety of ways, such as gluing, sewing, or crimping. The rods may be placed in a variety of regions throughout the spine of the book cover, such as along the head and foot of the book cover or in and around the middle of the book cover.

Figure 14:
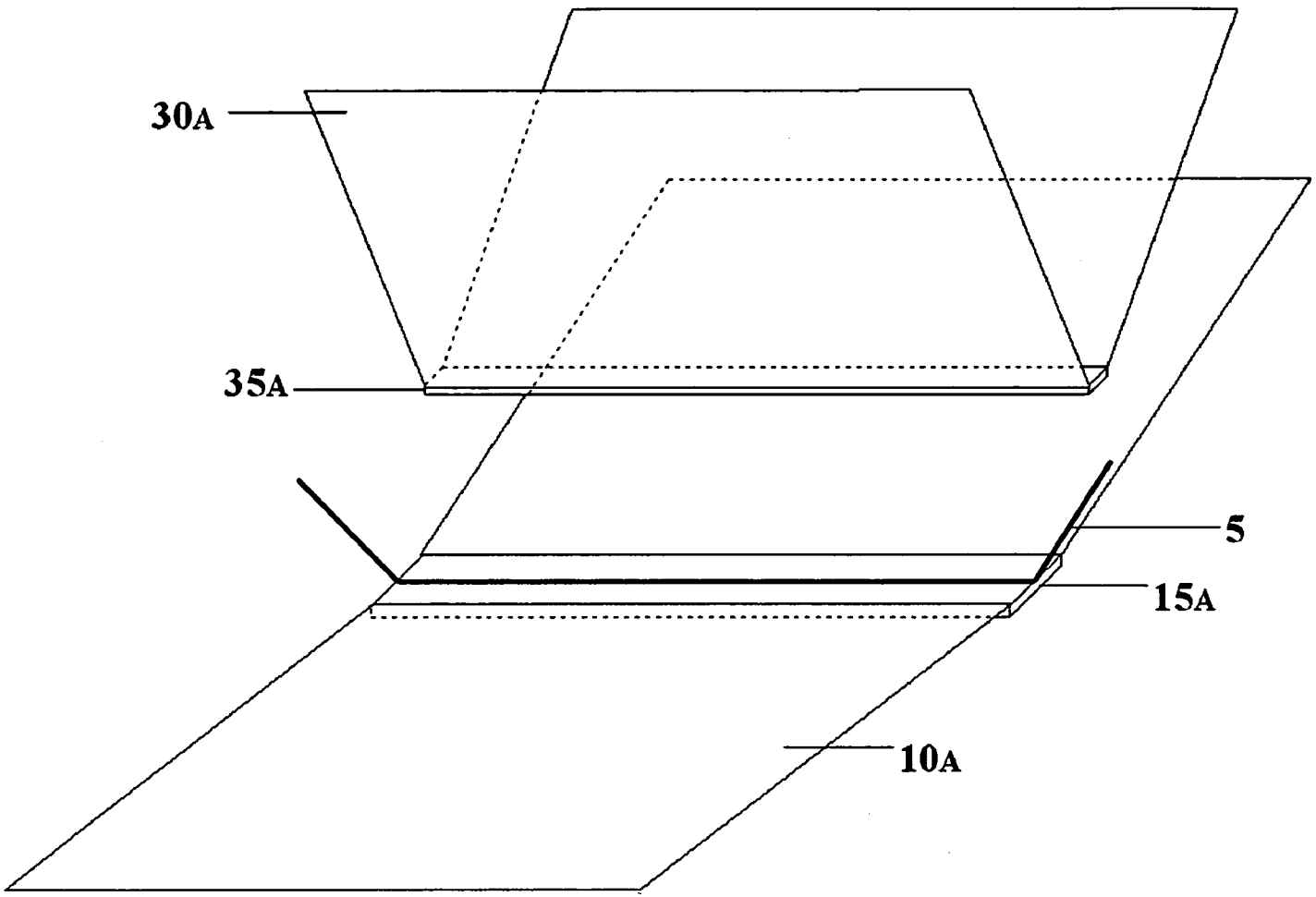
FIG. 14 is a perspective view of a mechanically-attaching embodiment using a book cover with flexible, durable rods along the interior spine of the book cover, according to an exemplary embodiment of the present invention.

FIG. 14 shows a flexible, durable rod 5 attached to the spine of the book cover 15A. This rod 5 bends and attaches the book cover 10A to the book section 30A. This rod 5 would attach in between the pages of the book section 30A, preferably towards the middle of the section's book block. Although this drawing shows the rod 5 extending the entire length of the spine region of the book cover 15A, a rod may be placed along the head and/or foot of the spine of the book cover 15A and have the same effect. The rod 5 may be attached along the interior, exterior, or within the layers of the spine of the book cover 15A by a variety of ways, including but not limited to gluing, taping, sewing, clamping, or crimping. The ideal construction for this embodiment is contemplated to have one rod 5 that attaches along the spine region of book cover 15A and extends beyond the head and foot of the spine region of book cover 15A. The rod 5 would be mostly enclosed within the layers of book cover 10A. The adhesive that binds the layers of the book cover 10A may also help to keep the rod 5 in place and add extra strength to its design.

One of the many uses of the present invention is for books that are traditionally bulky and heavy, and which may require updates and additional versions to be reprinted in an effort to contain the most current information. Sections of the book may be republished with the most up-to-date material. Users of the book may also choose to separate sections of the text from the whole by detaching the sections from the book cover. The sections may be removed by unclipping, unclamping, sliding, and/or pulling the individually-bound section members from the book cover.

As previously mentioned in the present disclosure, variations in the above embodiments includes a plurality of the adjoining members described for each embodiment.

Figure 15:
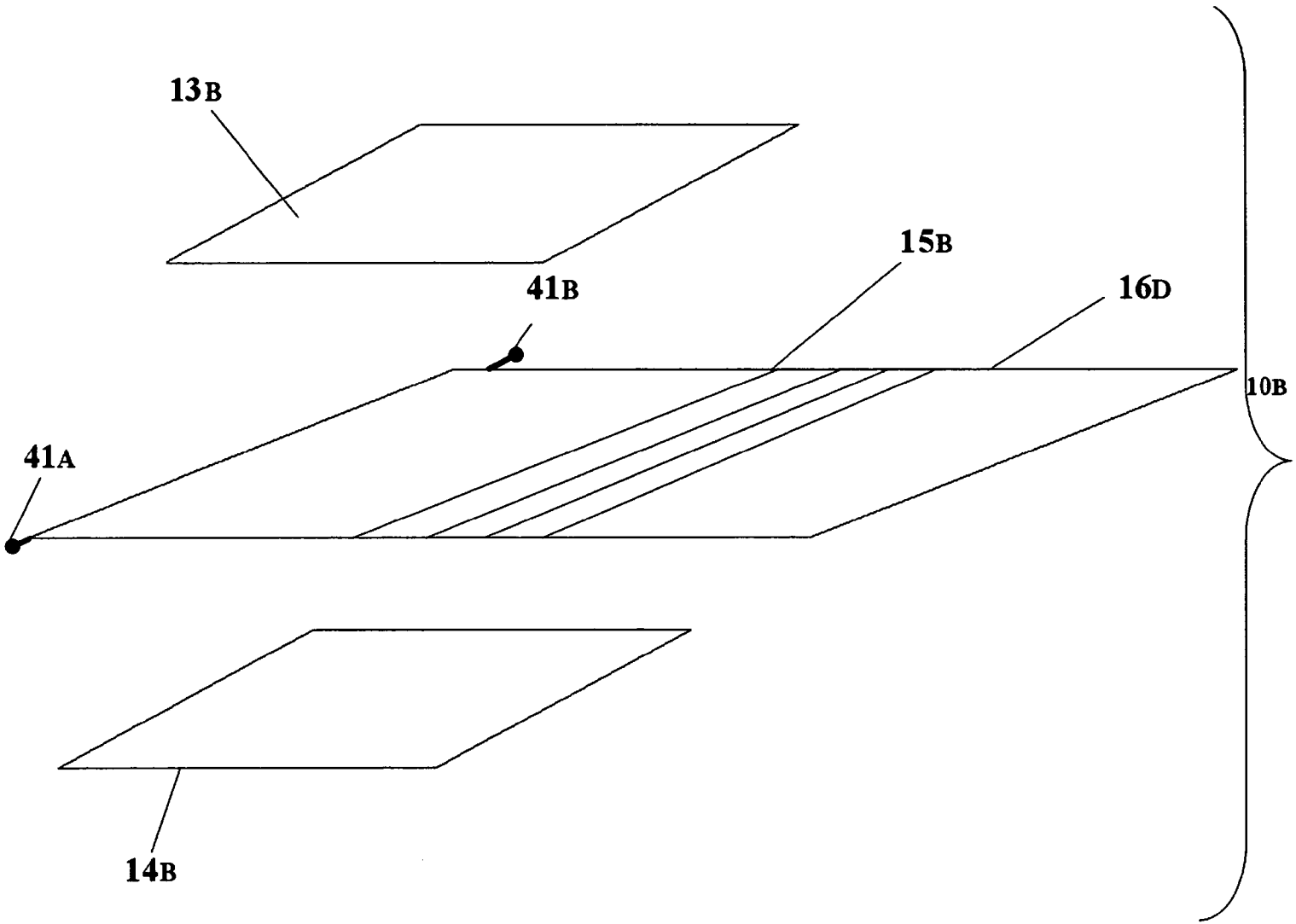
FIG. 15 is an exploded view of a book cover with a spine of variable width, employing a friction mechanism between the back book cover and the pocket formed by the front inner and outer covers, according to an exemplary embodiment of the present invention.

In FIG. 15, a book cover 10B with a spine of variable width 15B is illustrated. The contemplated embodiments of the present invention would work in the same or similar fashion using this book cover as with a book cover used in traditional case binding. The inner cover layer 13B of the book cover described in FIG. 15 is attached to the outer cover layer 14B of this book cover along three of its sides, such as by an adhesive, sewing, or interlocking mechanism. The open pocket along the fourth side allows room for the extended back cover 16D to be at least partially included in the opening. One version of this embodiment includes members that provide friction between the extended back cover 16D and the open pocket created by the inner cover layer 13B and the outer cover layer 14B. These friction members 41A and 41B may be made of a material such as but not limited to rubber. As the extended back cover 16D is pulled out its spine 15B increases. An ideal version of this embodiment would use scoring or some other ways of marking and sectioning the parts of the spine 15B.

Figure 16:
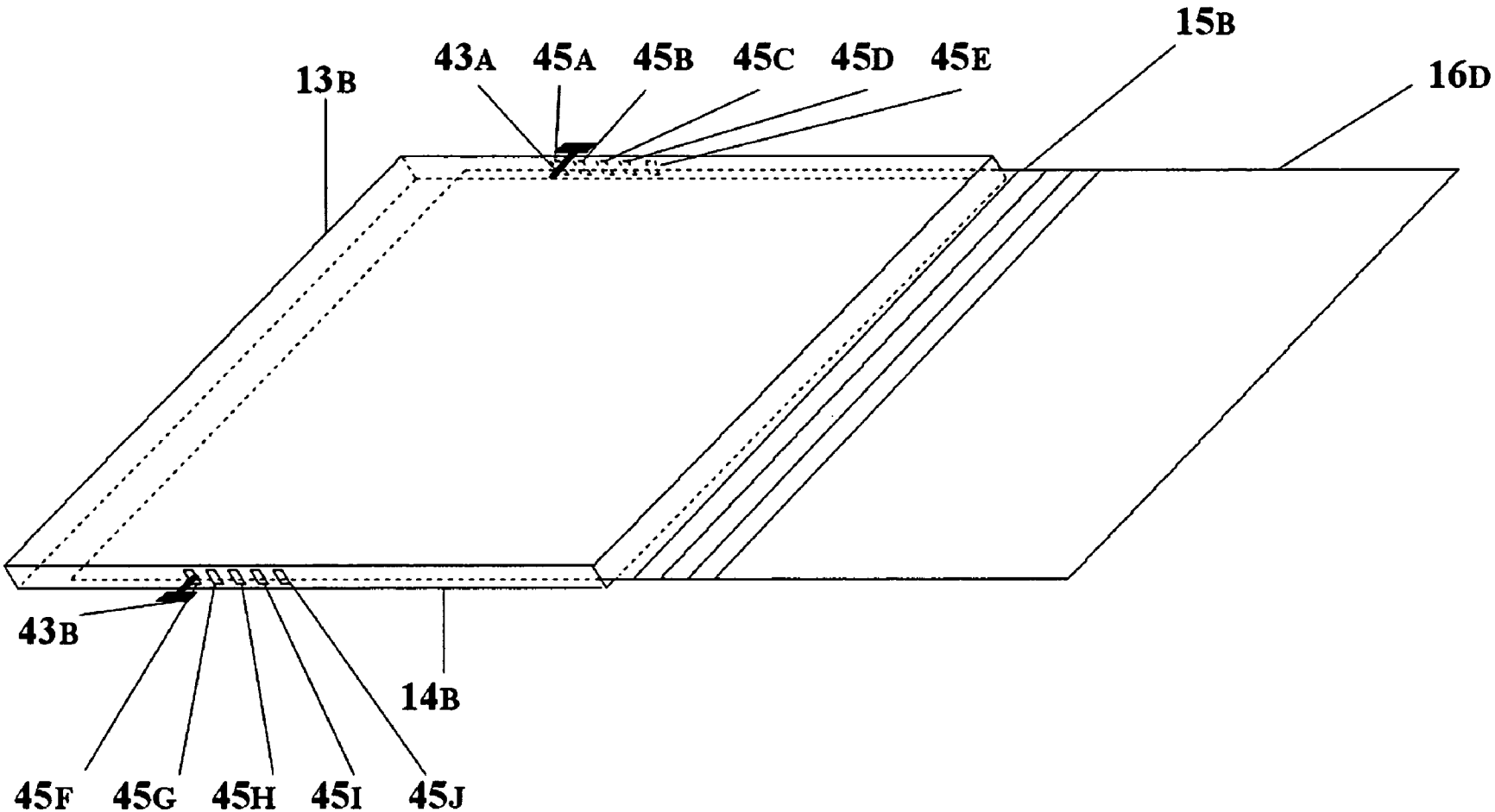
FIG. 16 is a view of a book cover with a spine of variable width, employing an interlocking mechanism between the back book cover and the pocket formed by the front inner and outer covers, according to an exemplary embodiment of the present invention.

Another exemplary version of this embodiment would include a locking mechanism along the parallel sides of the pocket which is created by joining the inner cover layer 13B and the outer cover layer 14B. This embodiment is depicted in FIG. 16, with interlocking members 43A and 43B attached along two edges of back cover 16D. Complimentary openings 45A, 45B, 45C, 45D, 45E, 45F, 45G, 45H, 451, and 45J are placed along the common axes between back cover 16D and the axes of the pocket formed from inner cover layer 13B and the outer cover layer 14B.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device for supporting a printed publication, the device comprising:

a cover having an elongated spine section including a first portion of a pressure fit attaching mechanism;

individually bound portions of a printed matter, each portion having an elongated spine section including a second portion of the pressure fit attaching mechanism;

wherein the first portion and the second portion of the pressure fit attaching mechanism interengage between the individually-bound portions and the cover, the pressure fit attaching mechanism comprising a convexity with a substantially spherical head on one of the first portion and second portion, and a concavity on the other of the first portion and second portion, the spherical head sized to insert into the concavity such that, when coupled together, the concavity and convexity attach to and are retained by the cover; and wherein to engage the individually-bound portions and the cover, the elongated spine section of the cover and the elongated spine section of each individually-bound portion are positioned parallel to each other and then pressed together in a direction perpendicular to the parallel elongated spines to releasable engage the first portion and the second portion of the pressure fit attaching mechanism with respect to the elongated spines.

2. The device of claim 1, wherein the cover contains a mechanical fastening device along the surface of its spine.

3. The device of claim 1, wherein the cover contains a cavity along its spine.

4. The device of claim 3, wherein the printed matter portions contain a complimentary convexity along their spines that can accommodate the cavity.

5. The device of claim 1, wherein the printed matter cover contains a convexity along its spine.

6. The device of claim 5, wherein the printed matter portions contain a complimentary concavity that can accommodate the convexity along their spines.

7. A book with detachable sections, comprising:

a book cover having an elongated spine section including a first portion of a pressure fit attaching mechanism;

individually bound sections containable within the book cover, each section having an elongated spine section including a second portion of the pressure fit attaching mechanism;

wherein the first portion and the second portion of the pressure fit attaching mechanism interengage between the individually-bound sections and the book cover, the pressure fit attaching mechanism comprising a convexity with a substantially spherical head on one of the first portion and second portion, and a concavity on the other of the first portion and second portion, the spherical head sized to insert into the concavity such that, when coupled together, the concavity and convexity attach to and are retained by the cover; and wherein to engage the individually-bound portions and the cover, the elongated spine section of the cover and the elongated spine section of each individually-bound portion are positioned parallel to each other and then pressed together in a direction perpendicular to the parallel elongated spines to releasable engage the first portion and the second portion of the pressure fit attaching mechanism with respect to the elongated spines.

8. The book of claim 7, wherein the book sections include at least one unique concavity and/or convexity and the book cover includes at least one complimentary unique convexity and/or concavity, which can be attached to the spines of the book section and book cover in a combination of adhesive, taping, sewing, and/or interlocking fashion.

* * * * *